US006799525B2

(12) United States Patent
Manos et al.

(10) Patent No.: US 6,799,525 B2
(45) Date of Patent: Oct. 5, 2004

(54) AUTOMATIC COAL DAMPER

(75) Inventors: Milton George Manos, Canton, OH (US); Donald K. Morrison, Clinton, OH (US); Robert William Waltz, Canton, OH (US); Thomas Kunzler, Clinton, OH (US); George Stiffler, Akron, OH (US); Chris Latham, Homeworth, OH (US); Robert Frato, Medina, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/242,794

(22) Filed: Sep. 13, 2002

(65) Prior Publication Data

US 2004/0050306 A1 Mar. 18, 2004

(51) Int. Cl.[7] ..... F23K 1/00; F23K 3/00

(52) U.S. Cl. ..... 110/106; 110/101 CF; 110/101 R; 110/104 R

(58) Field of Search ..... 110/104 R, 186, 110/187, 188, 101 CF, 101 R, 106, 347; 138/46; 137/601.11, 601.08

(56) References Cited

U.S. PATENT DOCUMENTS

| | | | | | |
|---|---|---|---|---|---|
| 3,286,732 | A | * | 11/1966 | Alley | 137/601 |
| 4,151,804 | A | * | 5/1979 | Wache et al. | 108/147 |
| 4,316,420 | A | * | 2/1982 | Kochey | 110/347 |
| 4,459,922 | A | * | 7/1984 | Chadshay | 110/265 |
| 4,512,200 | A | * | 4/1985 | Ghering et al. | 73/861.04 |
| 4,517,906 | A | * | 5/1985 | Lewis et al. | 110/346 |
| 4,885,999 | A | * | 12/1989 | Baba et al. | 110/186 |
| 5,048,761 | A | | 9/1991 | Kim | |
| 5,593,131 | A | | 1/1997 | Briggs, Jr. et al. | |
| 5,626,085 | A | * | 5/1997 | Donais et al. | 110/188 |
| 5,685,240 | A | | 11/1997 | Briggs, Jr. et al. | |
| 5,765,592 | A | * | 6/1998 | Karlicek | 137/601.06 |
| 5,809,831 | A | * | 9/1998 | Nagai et al. | 74/89.4 |
| 5,975,141 | A | | 11/1999 | Higazy | |
| 6,009,899 | A | | 1/2000 | Polutnik | |
| 6,109,097 | A | | 8/2000 | Conrads et al. | |
| 6,155,183 | A | * | 12/2000 | Vierstra et al. | 110/345 |
| 6,186,079 | B1 | | 2/2001 | Wark et al. | |
| 6,234,090 | B1 | | 5/2001 | Wark et al. | |
| 6,289,266 | B1 | | 9/2001 | Payson et al. | |

OTHER PUBLICATIONS

Clean Coal Technology Project Proposal—Automatic Coal Damper, Milt Manos, May 4, 2001; submitted by GE Energy and Environmental Research Corporation to the Ohio Goal Development Office on May 4, 2001.

* cited by examiner

*Primary Examiner*—Kenneth Rinehart
(74) *Attorney, Agent, or Firm*—Nixon & Vanderhye P.C.

(57) ABSTRACT

Apparatus for controlling primary air flow and pulverized coal flow to a plurality of burners in a coal-fired boiler includes a plurality of coal dampers arranged to supply a mixture of air and pulverized coal to respective burners in the coal-fired boiler, each damper having a damper body and at least two orifice plates pivotally secured therein, the orifice plates movable between open and closed positions; a real time coal flow monitoring device operatively associated with each damper that is adapted to generate analog signals representing real time coal flow through its respective damper; and a programmable logic controller adapted to receive the analog signals and to adjust the orifice plates to balance the flow of air and pulverized coal to each of the plurality of burners.

23 Claims, 22 Drawing Sheets

AUTOMATIC COAL DAMPER

This invention relates to the control of air and pulverized coal supplied to the burners of a coal-fired boiler and, specifically, to automatic coal dampers and related control systems.

BACKGROUND OF THE INVENTION

Coal-fired boilers typically have multiple arrangements of coal pulverizing mills, each mill supplying coal through multiple pipes to multiple burners within the boiler. Each parallel coal supply path typically originates at a respective pulverizer mill and terminates at the individual burner mounted in the boiler. Each coal pipe has its own characteristic mechanical system performance/resistance properties for the two phase flow of air flow and coal flow, and this varies for each parallel coal pipe path at any given time and boiler load, based upon a number of system factors relating to both equipment and process variables. For example, equipment such as a forced draft fan, air heater, primary air fan, coal feeder, coal pulverizer, coal classifier, riffle box/fixed orifice, piping system, elevation, air flow and coal flow monitor, coal damper, burner isolation valve, burner, boiler, and process parameters such as elevation, air temperature, air pressure, air flow, coal flow, coal density, coal moisture, coal composition and coal particle size all impact the performance/resistance characteristics of the system. In other words, as the boiler load changes and as the individual mechanical factors vary for each coal pipe, the air/coal system performance and resistance changes for the total coal piping system and each individual coal pipe within that system.

It is known that the balance of coal flow to the burners in a coal-fired power plant can have significant impacts on combustion efficiency, residual carbon in fly ash, and NOx emissions. Even a small burner-to-burner imbalance can significantly impact boiler performance. Coal flow balancing of multiple burner boilers is a difficult problem for engineers and operators to solve. It is typically performed as an iterative series of manual coal flow measurements and adjustments of flow restrictive devices in the coal piping. With the introduction of manual coal dampers, coal flow has been balanced by adjusting each manual damper in each of the pulverized coal pipes that supplies the burners from a single mill. The coal flow rates in each pipe are measured manually by sampling with a coal probe traversing across the coal pipe area. While this approach had the potential to achieve approximate balance, changes in fuel consumption, operating conditions and wear on the orifice plates resulted in uncontrollable coal flow balance variations.

Real time coal flow monitoring systems are now available and are described in the patent literature. See, for example, U.S. Pat. Nos. 6,109,097; 6,289,266; and 5,048,761. Variable orifices for coal pipes are disclosed in U.S. Pat. Nos. 5,975,141; 5,685,240; 6,009,899 and 6,234,090. Presently, however, there is no known coal damper arrangement which links real time air flow and coal flow signals to changes in the primary air/coal flow system resistance and the functional process of changing the coal damper position to an optimum operating set point.

BRIEF DESCRIPTION OF THE INVENTION

The automatic coal damper in accordance with this invention provides a more practical method of achieving coal flow balance conditions for a boiler. The automatic coal damper also allows coal flow adjustments based upon varied boiler load, and may apply neural network technology. It also operates for particular coal flow settings which may optimize the boiler combustion and air emission levels.

Specifically, this operating scheme is designed to give operators the ability to balance coal flow from a mill so as to distribute the coal equally among the burners of the coal-fired boiler. A well-balanced coal flow system should improve boiler efficiency, minimize NOx and CO formation, while achieving maximum or desired Kilowatt production. The associated performance data will interface with the power plant control and/or data acquisition system to permit real time online adjustment of the coal dampers to thereby balance the coal flow among the various parallel paths to the burners.

In the exemplary embodiment, the individual coal damper position is changed automatically based on real time coal flow signals to provide the optimum operating set point for each coal damper. In other words, the automatic coal damper balances the system resistance, allowing the coal flow of each burner to be maintained at an optimum operating set point. Ideally, the optimum operating set point is usually, but not necessarily, an equal air flow for each individual burner of the coal-fired boiler.

There are two new orifice plate designs disclosed herein for the automatic coal damper: dual action orifice plates and quad action orifice plates (and variations of each) adjusted by, for example, an electric motor linear actuator. However, the invention here is also applicable to known single action orifice plates, where one slidable plate is adjusted manually and the other plate is adjusted by the actuator. For the dual action orifice plates design in accordance with this invention, both plates swing simultaneously, at the same angular position to any point between a fully closed position and a fully open position. The size of the orifice opening at the fully closed position is set at a certain percentage of the full open position, but the orifice opening size and shape (for example, diamond, circle, oval or other) may be customized for the requirements of a particular boiler installation. A self-cleaning feature may be included for the dual action orifice plates design, in that the plates may swing 180° from a full up and open position beyond the full closed position, to a full down position such that any coal build up on the normally top side of the plates may be removed by gravity or primary air pressure.

The automatic coal damper normally installed in vertical sections of coal piping, usually near the exit of the coal pulverizer.

The mechanical drive mechanism for adjusting the dual action orifice plates includes an electric motor linear actuator that pushes a rod attached to a cam that has dual slots, one for each of the two driven orifice plates. Each slot captures a roller which is linked at the end of a fulcrum arm on a cam rotor. The cam rotors rotate from zero to ninety degrees and the orifice plates similarly rotate from zero to ninety degrees. Each orifice plate is welded (or otherwise fixed) to a shaft and the two shaft ends are supported by two bearings which are mounted externally on opposite sides of the damper body. The shaft ends are fixed to the opposite ends of the fulcrum arm so that the cam rotors and orifice plates rotate simultaneously through the same angle.

For the quad action orifice plates design, the same mechanical drive mechanism with two swing orifice plates as described above is used, but additionally, there are two idler orifice plates which are connected to the two adjacent driven orifice plates by two connecting, triangular-shaped hinged plates. The advantage of the quad action orifice plates is that the orifice remains symmetrically centered within the coal pipe.

Ceramic sleeve hinges are used to connect the driven orifice plates to the idler plates at four locations, allowing the idler plates to rotate freely about the hinges in the abrasive and hot environment typical of coal piping applications. The ceramic sleeve arrangement also prevents coal from binding the rotation action of the pivot shafts. The two triangular shaped orifice plates at each interface of a driven plate and an adjacent idler plate fold together in the fully closed orifice position and fold completely apart in the fully open orifice position. The size and orientation of the orifice plates may be customized for the requirements of a particular boiler installation.

In an alternative and presently preferred damper body design, the damper is a dual plate type, where the body housing is round rather than rectangular or square. This design thus maintains the same cross-sectional shape for the flow path through the damper as in the coal piping on either side of the damper.

In the control process, a known coal flow monitor measuring system takes velocity and coal flow measurements from each pipe, and a suitable programmable logic controller, integrated with the measuring system, makes small percentage adjustments to each damper, when necessary, to balance out the coal flow in each pipe.

Accordingly, in one aspect, the invention relates to apparatus for controlling primary air flow and pulverized coal flow to a plurality of burners in a coal-fired boiler comprising a plurality of coal dampers arranged to supply a mixture of air and pulverized coal to respective burners in the coal-fired boiler, each damper having a damper body and at least two orifice plates pivotally secured therein, the orifice plates movable between open and closed positions; a real time coal flow monitoring device operatively associated with each damper that is adapted to generate analog signals representing real time coal flow through its respective damper; and a programmable logic controller adapted to receive the analog signals and to adjust the orifice plates to balance the flow of air and pulverized coal to each of the plurality of burners.

In another aspect, the invention relates to an automatic coal damper for use in controlling flow of primary air and pulverized coal to a burner of a coal-fired boiler comprising a damper body having pipe sections on either end thereof, the damper body having at least two adjustable orifice plates secured to respective pivot shafts mounted in the damper body, and a linear actuator mounted on the damper body and operatively connected to the pivot shafts for moving the orifice plates between open and closed positions.

In still another aspect, the invention relates to a coal-fired boiler plant comprising plural parallel piping paths from at least one pulverizer mill that supply air and pulverized coal to a corresponding plurality of burners of a coal-fired boiler; a plurality of mechanical dampers located, respectively, in the plural parallel piping paths, each damper having at least a pair of pivotally adjustable orifice plates; and means for adjusting the orifice plates in real time to balance the flow of air and pulverized coal for each of the plural parallel piping paths.

The invention will now be discussed in detail in connection with the drawing figures briefly described below.

DETAILED DESCRIPTION OF THE INVENTION

Figure 1:
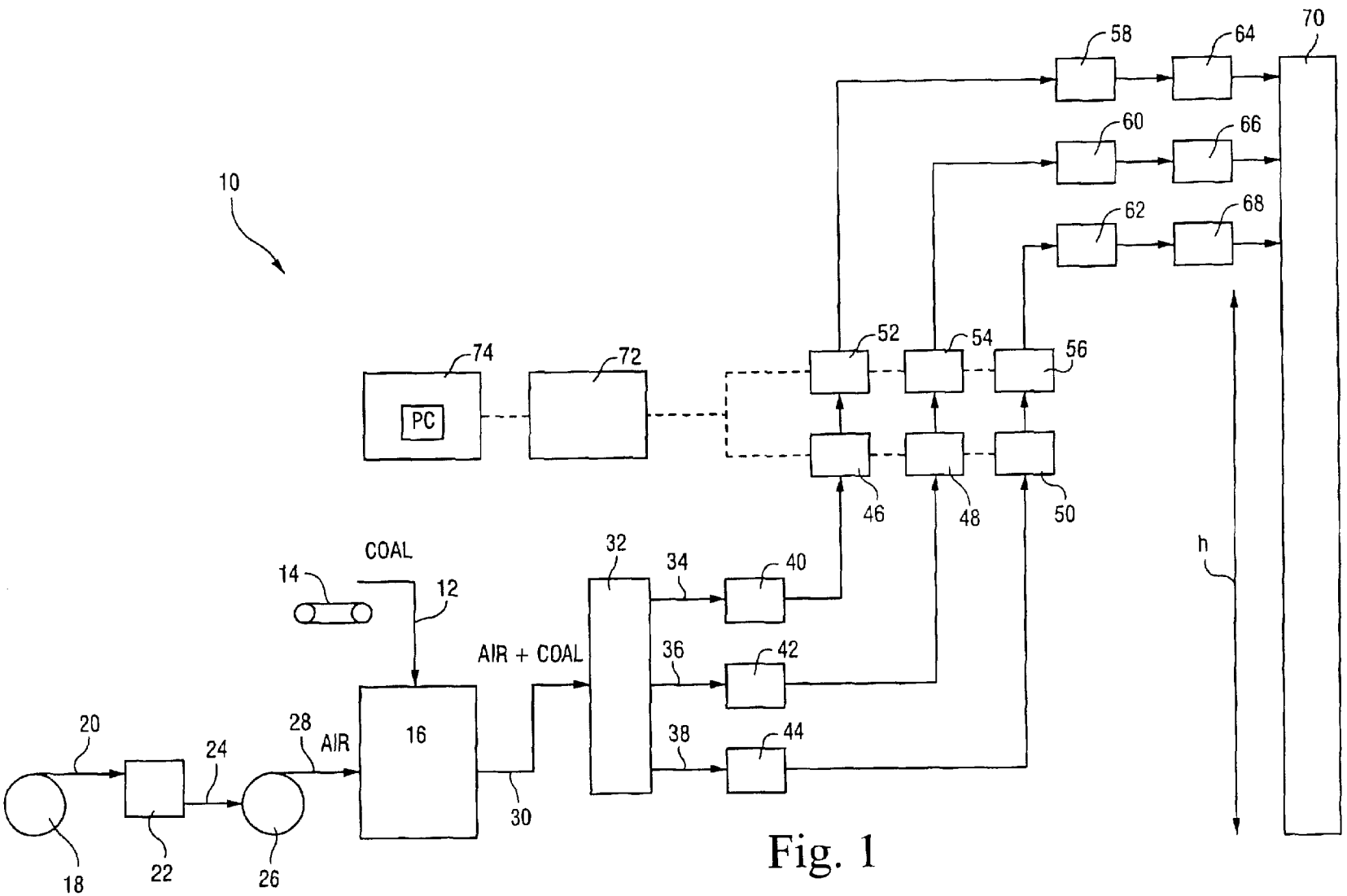
FIG. 1 is a schematic diagram of a coal-fired boiler incorporating automatic control dampers in accordance with this invention.

FIG. 1 illustrates a process flow diagram 10 for a coal fired boiler in accordance with the invention. Coal is supplied via stream 12 from a coal feeder 14 to a coal pulverizer 16. At the same time, air is supplied by a forced draft fan 20 to an air heater 22 and then, via stream 24 and primary air fan 26 to the pulverizer. The pulverizer 16 supplies an air/coal mixture via stream 30 to a coal classifier 32. From here, the coal/air mixture is supplied via parallel coal paths to the individual burners in the boiler. Specifically, in the illustrated embodiment, three separate parallel paths, indicated by streams (or pipes) 34, 36 and 38 supply individual air/coal mixtures through respective riffle box/fixed orifice stations 40, 42 and 44, past respective air flow and coal flow monitors 46, 48 and 50, and then through discrete respective automatic coal dampers 52, 54 and 56. The coal piping then feeds the individual streams to respective burner isolation valves 58, 60 and 62 and then into the respective burners 64, 66 and 68 mounted on the boiler 70. Note the burners are installed at a predetermined elevation "h" within the boiler. A control system 72 adjusts the individual coal dampers 52, 54, 56, based on the signals received from the air flow and coal flow monitors 46, 48 and 50. As indicated above, the coal flow monitors 46, 48 and 50 measure the coal flow and convert the measurements into 4–20 multi-amp signals. The coal flow monitors are integrated with, for example, a programmable logic controller and suitable software that makes up the control system 72. A generic personal computer 74 is also included in the control system 72 for displaying the operator interface graphics.

Figure 2:
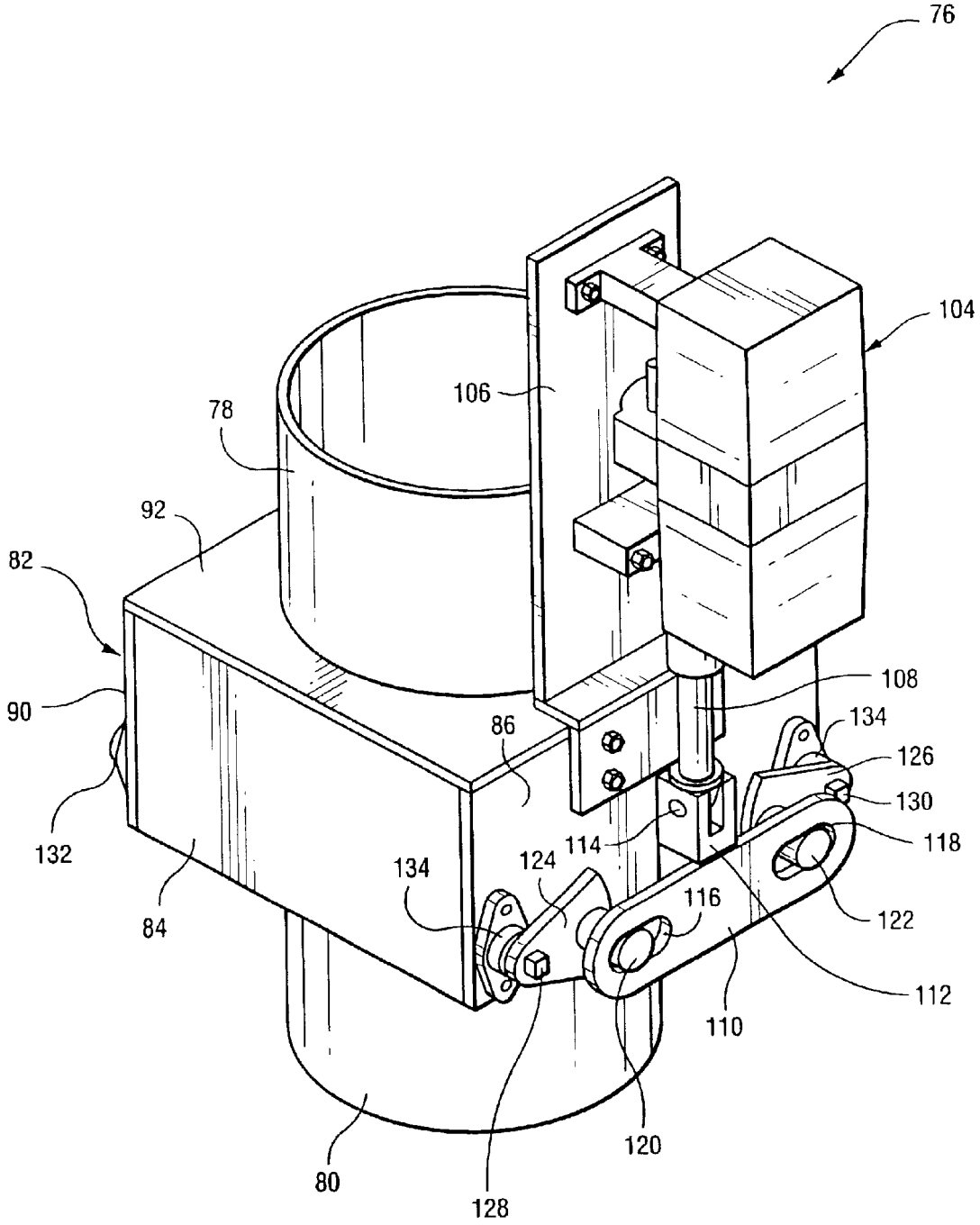
FIG. 2 is a perspective view of a first embodiment of an automatic coal damper in accordance with the invention.
Figure 3:
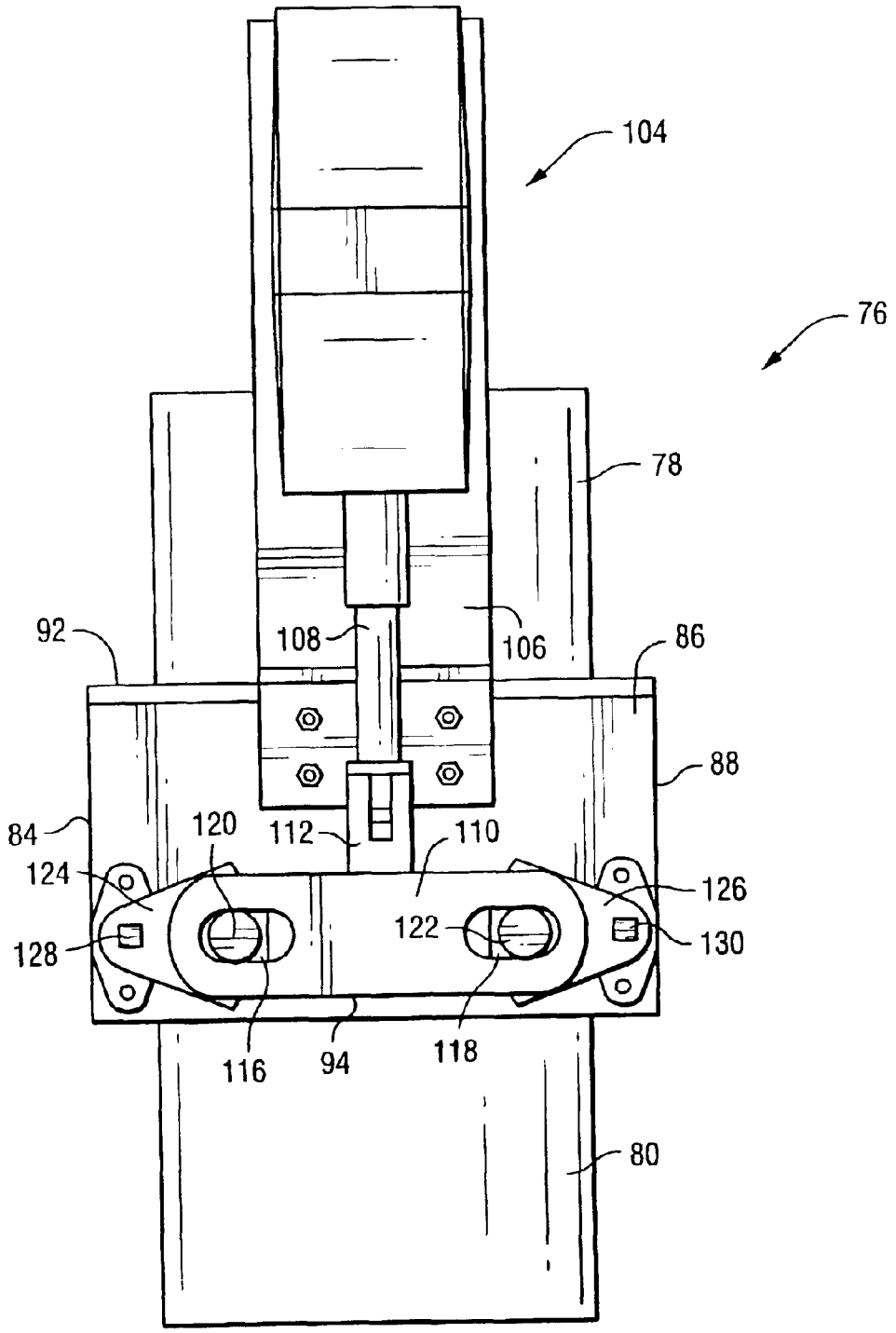
FIG. 3 is a side elevation of the coal damper shown in FIG. 2.
Figure 4:
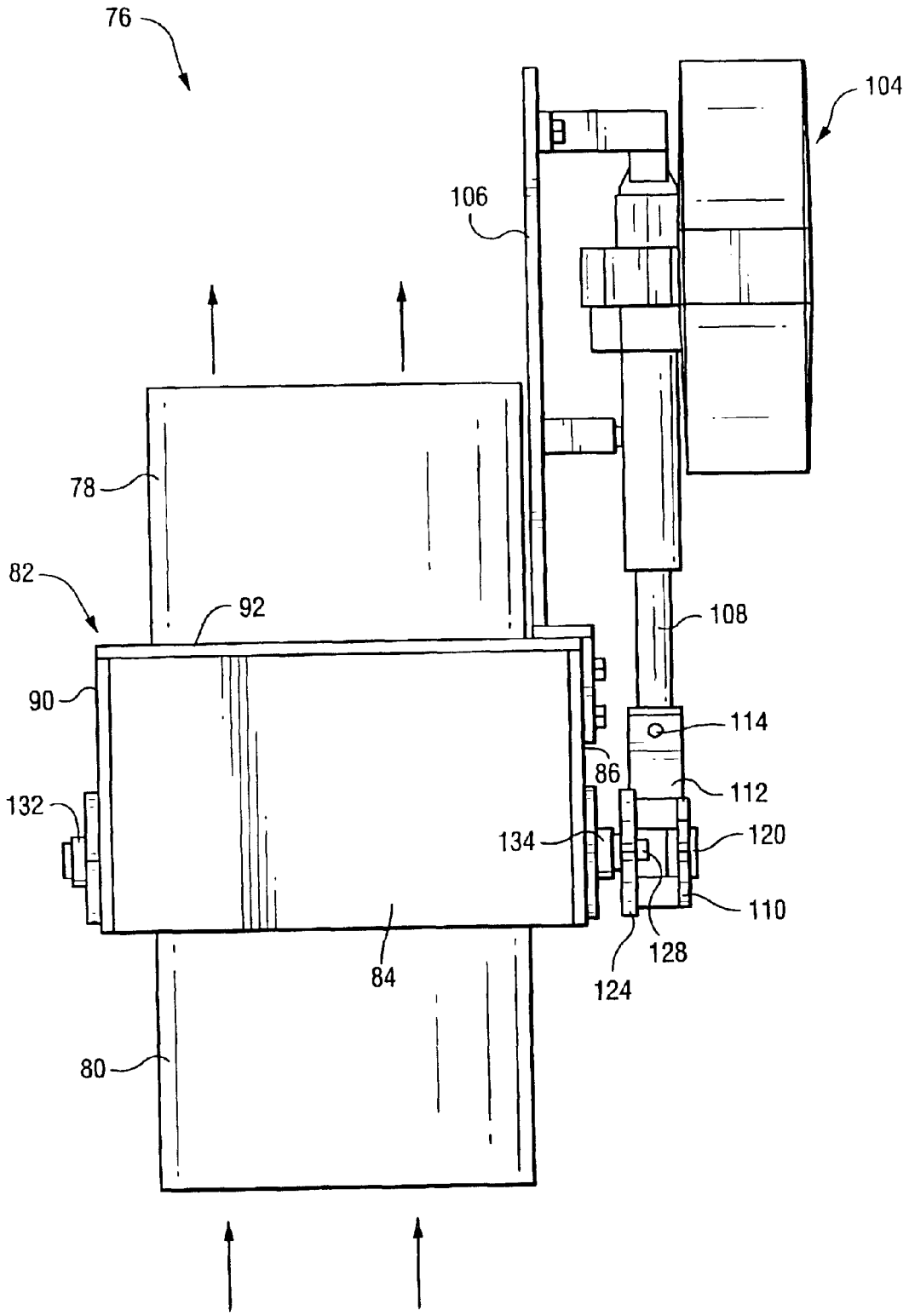
FIG. 4 is a front elevation of the automatic coal damper shown in FIG. 1.

With reference to FIGS. 2–4, an adjustable coal damper 76 in accordance with one exemplary embodiment of the invention includes pipe sections 78, 80 on either side of a damper body 82. It will be appreciated that pipe sections 78, 80 connect to the coal piping on either side of the damper (52, for example, in FIG. 1). The damper body 82 comprises a box-like housing with side walls 84, 86, 88, and 90, a top panel 92 and a bottom panel 94. One or more of the panels or side walls may be removable to provide easy access to the orifice plates. Within the damper body 82, there are a pair of orifice plates 96, 98 (see also FIGS. 5 and 6) mounted for rotation on pivot shafts 100, 102, respectively. The pivot shafts 100, 102 are secured to opposite side walls 86, 90 of the damper body, oriented perpendicular to the pipe sections 78, 80, such that when the orifice plates are in the closed position (as in FIG. 5), they are also perpendicular to the direction of flow through the damper body.

An electric motor linear actuator 104 operates to adjust the position of the orifice plates 96, 98 between fully open and fully closed positions. The actuator 104 may be a Jordan Linear Actuator, but other suitable actuators (including a Jordan Rotary Actuator) may be utilized as well. The actuator 104 is secured to a bracket 106 fixed to the damper body 82, and has a reciprocable output shaft or rod 108 arranged parallel to the pipe sections 78, 80. The rod 108 is attached to a slotted cam plate 110 by means of a clevis 112 and associated pin 114. The cam 110 is formed with a pair of cam slots 116, 118, each cam slot capturing a roller 120, 122, respectively. The rollers 120, 122 are attached to ends of respective cam rotors 124, 126 with the opposite ends of the cam rotors keyed to the squared ends 128, 130 of the pivot shafts 100, 102. It will be appreciated that the shafts are secured to the damper body walls 84, 86 by means of respective bearings 132, 134 that permit the shafts to rotate relative to the damper body walls.

Figure 5:
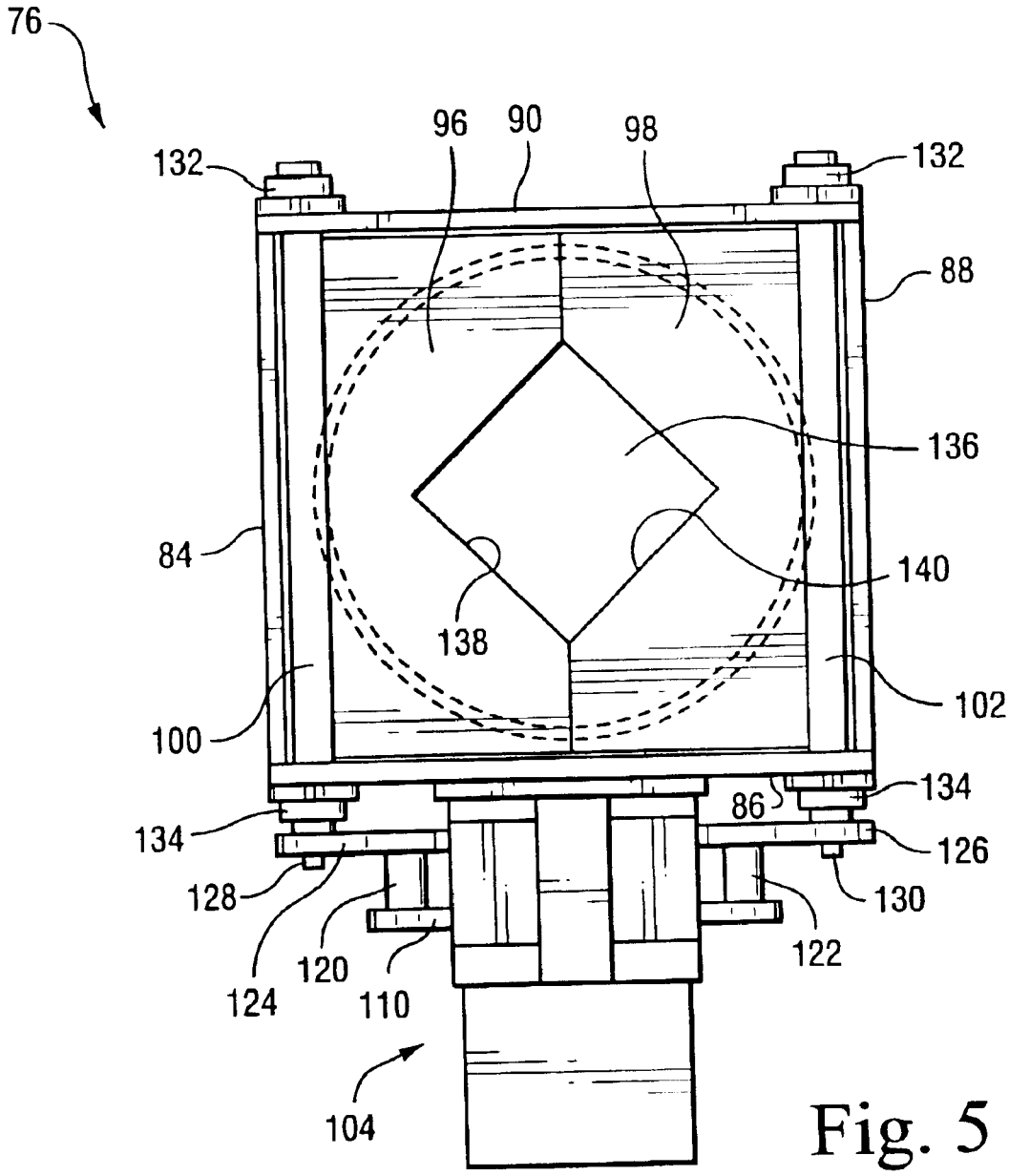
FIG. 5 is a plan view of the coal damper shown in FIG. 1, with an upper pipe section removed for clarity, and showing orifice plates in a fully closed position.
Figure 6:
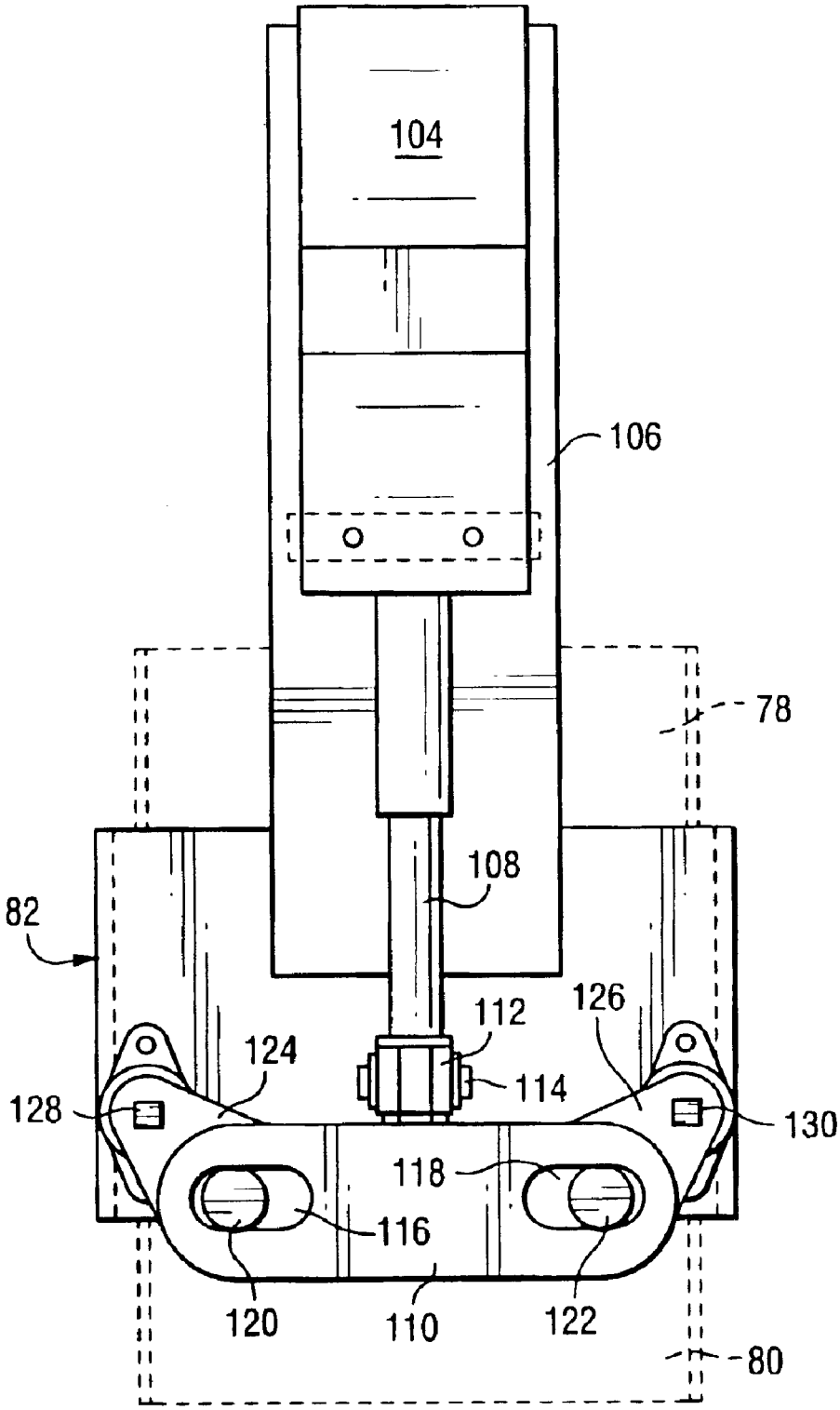
FIG. 6 is a front elevation of the damper shown in FIG. 5.
Figure 7:
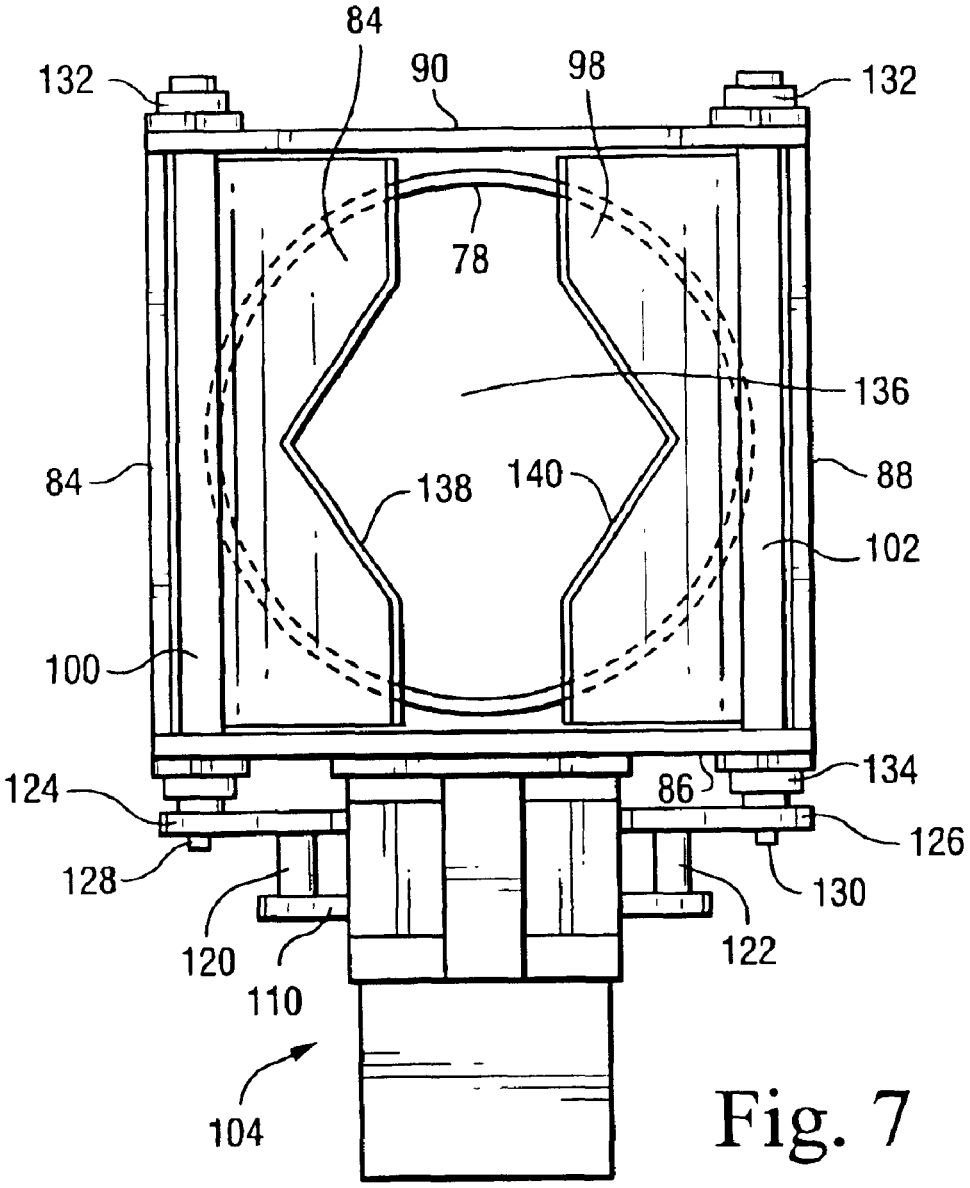
FIG. 7 is a plan view of the coal damper similar to FIG. 5, but with the orifice plates in a 45° position.
Figure 8:
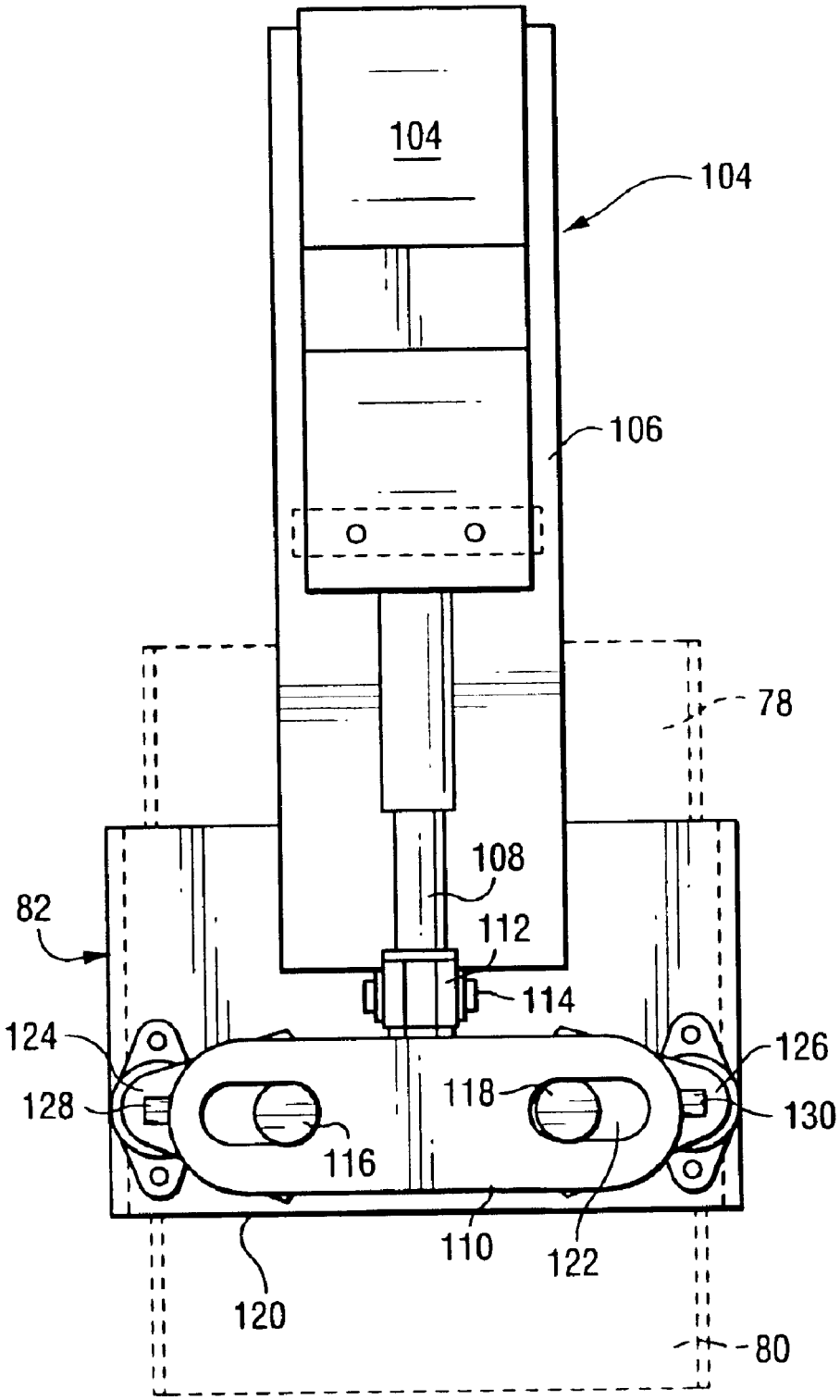
FIG. 8 is a front elevation of the damper shown in FIG. 7.
Figure 9:
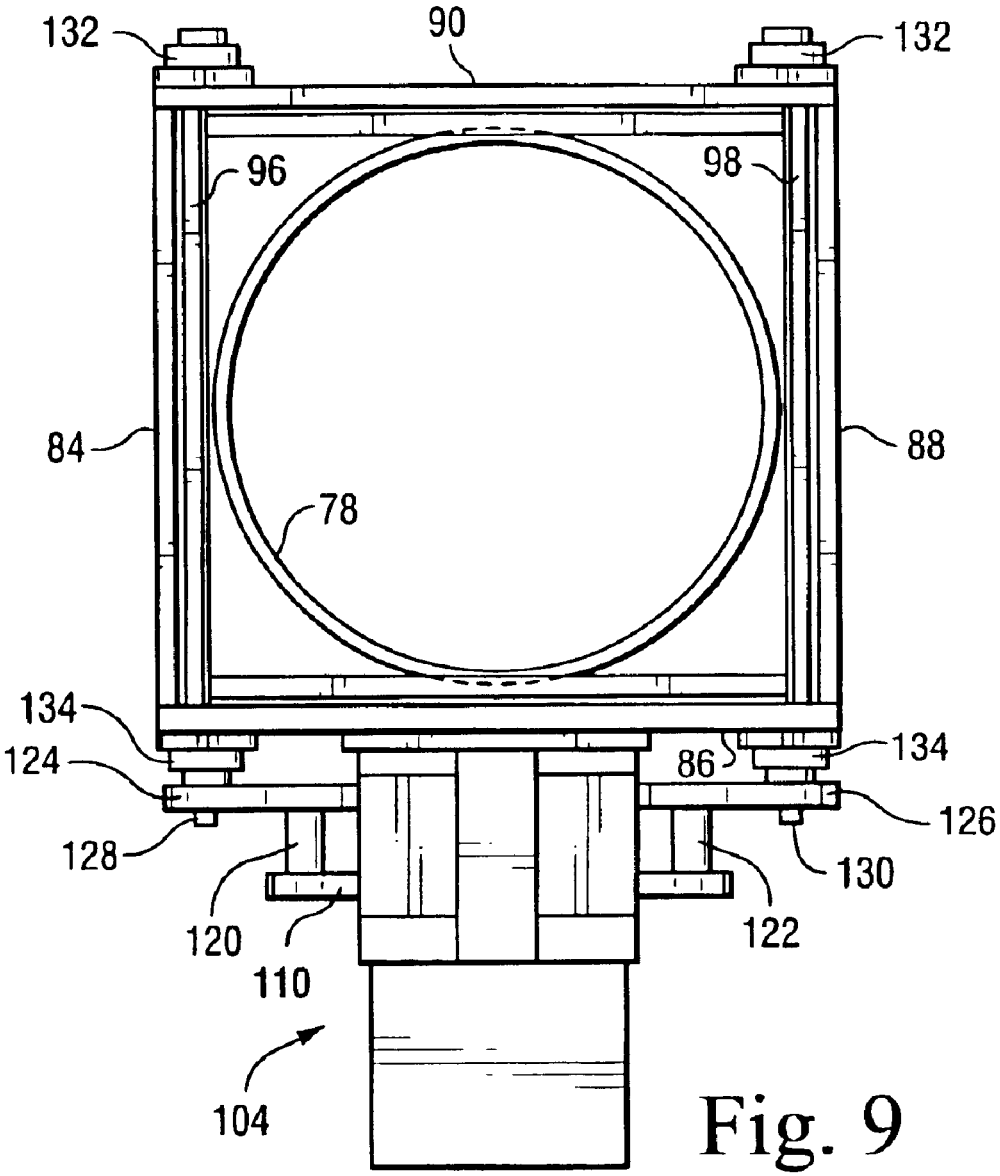
FIG. 9 is a plan view of the damper similar to FIGS. 5 and 7, but with the orifice plates in a fully open position.
Figure 10:
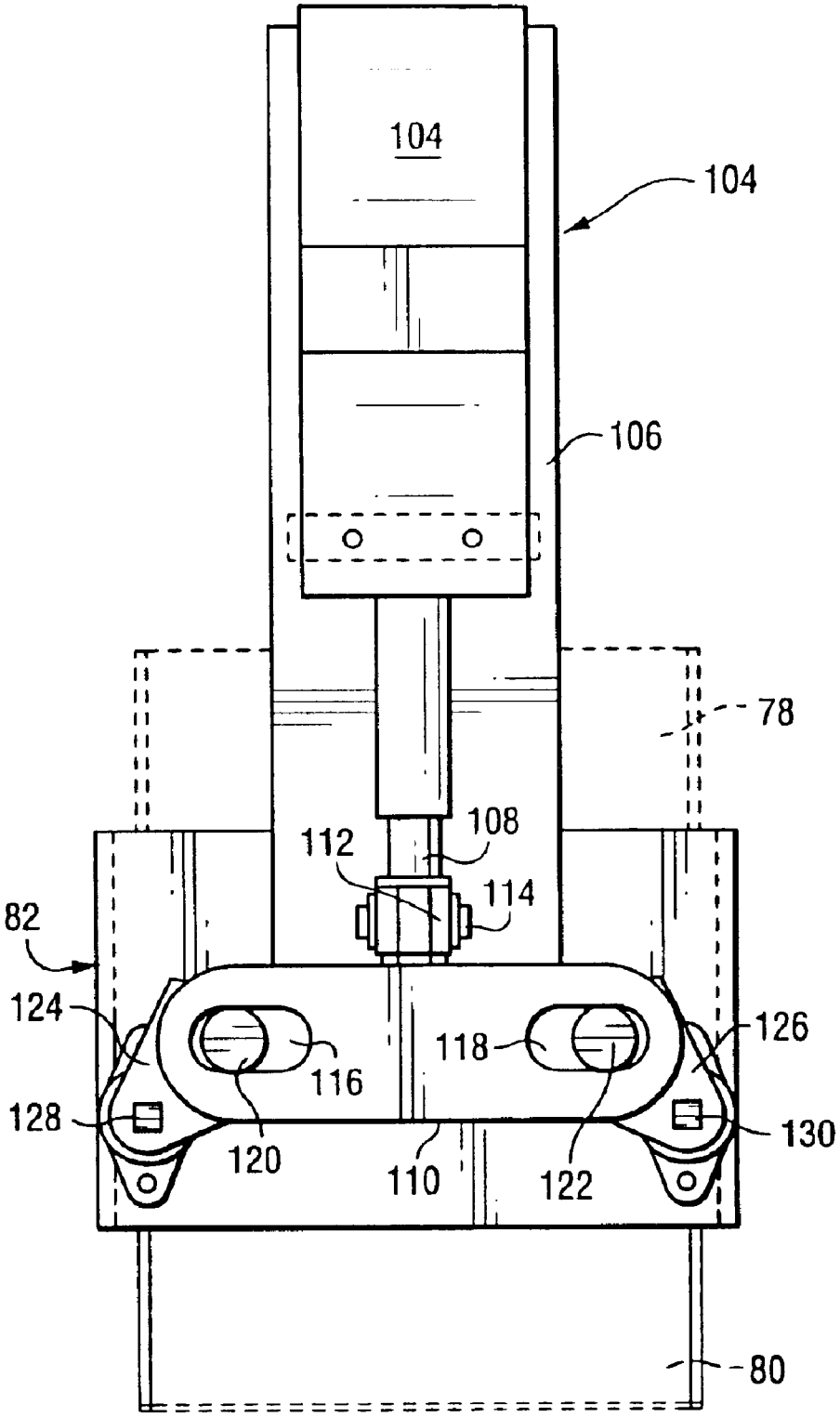
FIG. 10 is a front elevation of the coal damper as shown in FIG. 9.

With continuing reference to FIGS. 2–4 as well as FIGS. 5–10, it will be appreciated that when the linear actuator rod 108 moves in an upward direction, the slotted cam plate 110 will also move upwardly, causing the cam rotors 124, 126 to rotate in opposite directions (rotor 124 counterclockwise and rotor 126 clockwise) with the orifice plates 96, 98 simultaneously pivoting upwardly and away from each other to increase the size of the damper orifice 136. FIGS. 5 and 6 illustrate the damper when the orifice plates 96, 98 are in a fully closed position, noting that the orifice 136 formed by mirror image cut-outs 138, 140 that create a diamond-shaped orifice when the plates 96, 98 are closed. FIGS. 7 and 8 illustrate the rotor plates at about a 45° angle while FIGS. 9 and 10 illustrate the orifice plates in a fully open position, i.e., with the orifice plates 96, 98 parallel to the side walls 84, 88 of the damper body. In the fully closed position (FIG. 5), the orifice 136 is approximately 25% of the orifice size when the plates are in the fully open position (FIG. 9). The direction of the coal/air flow through the damper is indicated by flow arrows in FIG. 4.

Figure 11:
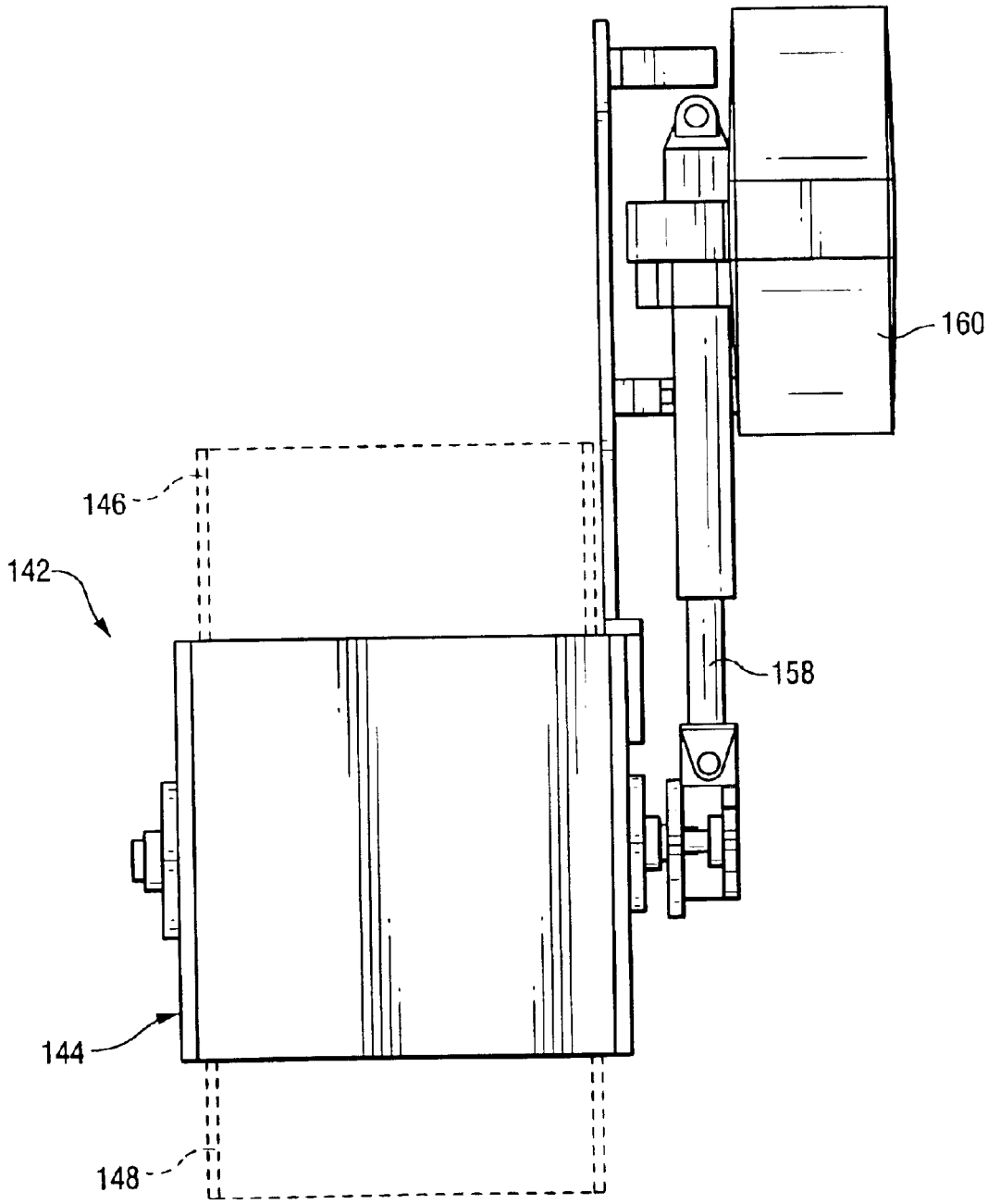
FIG. 11 is a front elevation of a coal damper in accordance with a second exemplary embodiment of the invention.
Figure 12:
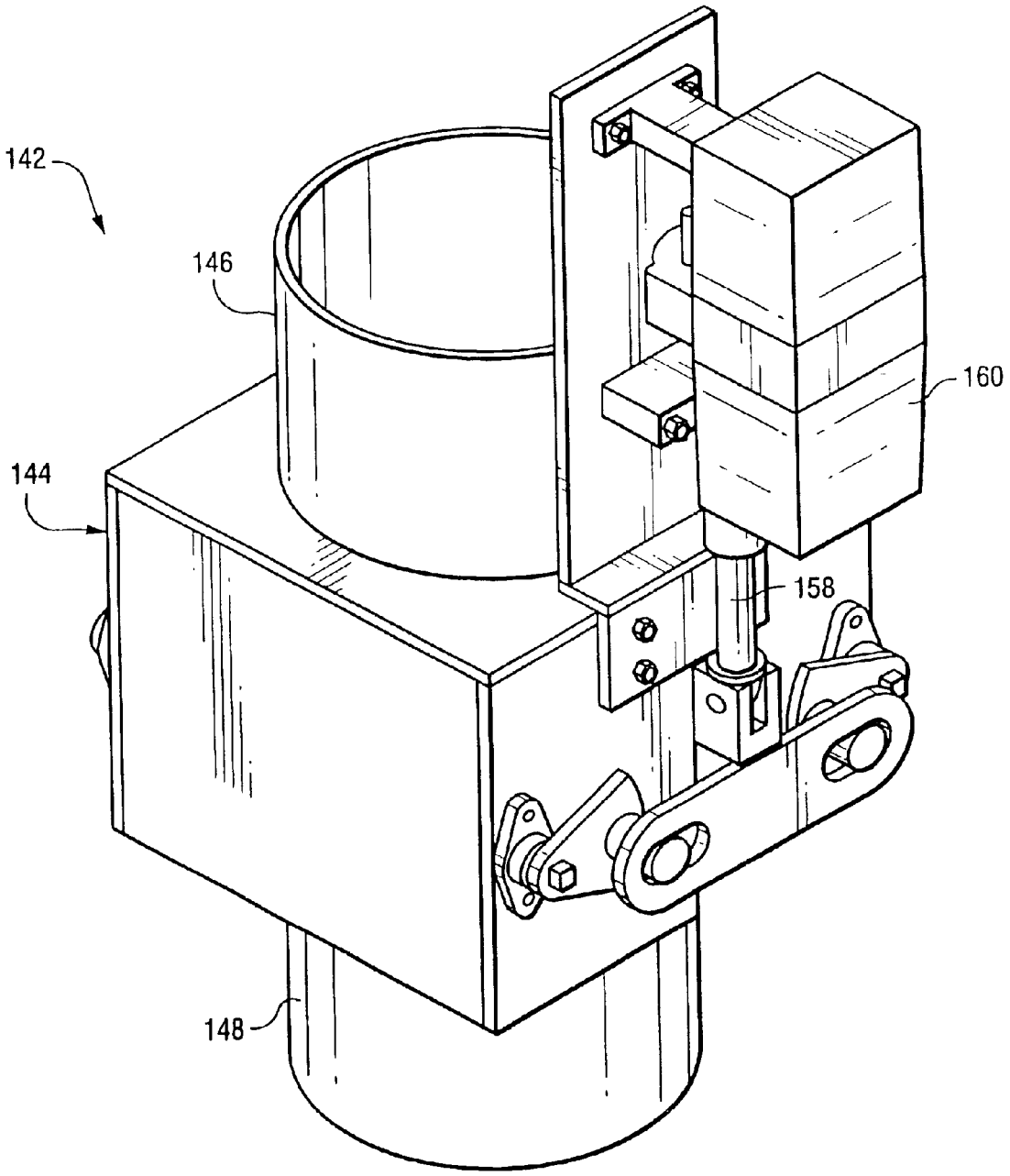
FIG. 12 is a perspective view of the coal damper shown in FIG. 11.
Figure 13:
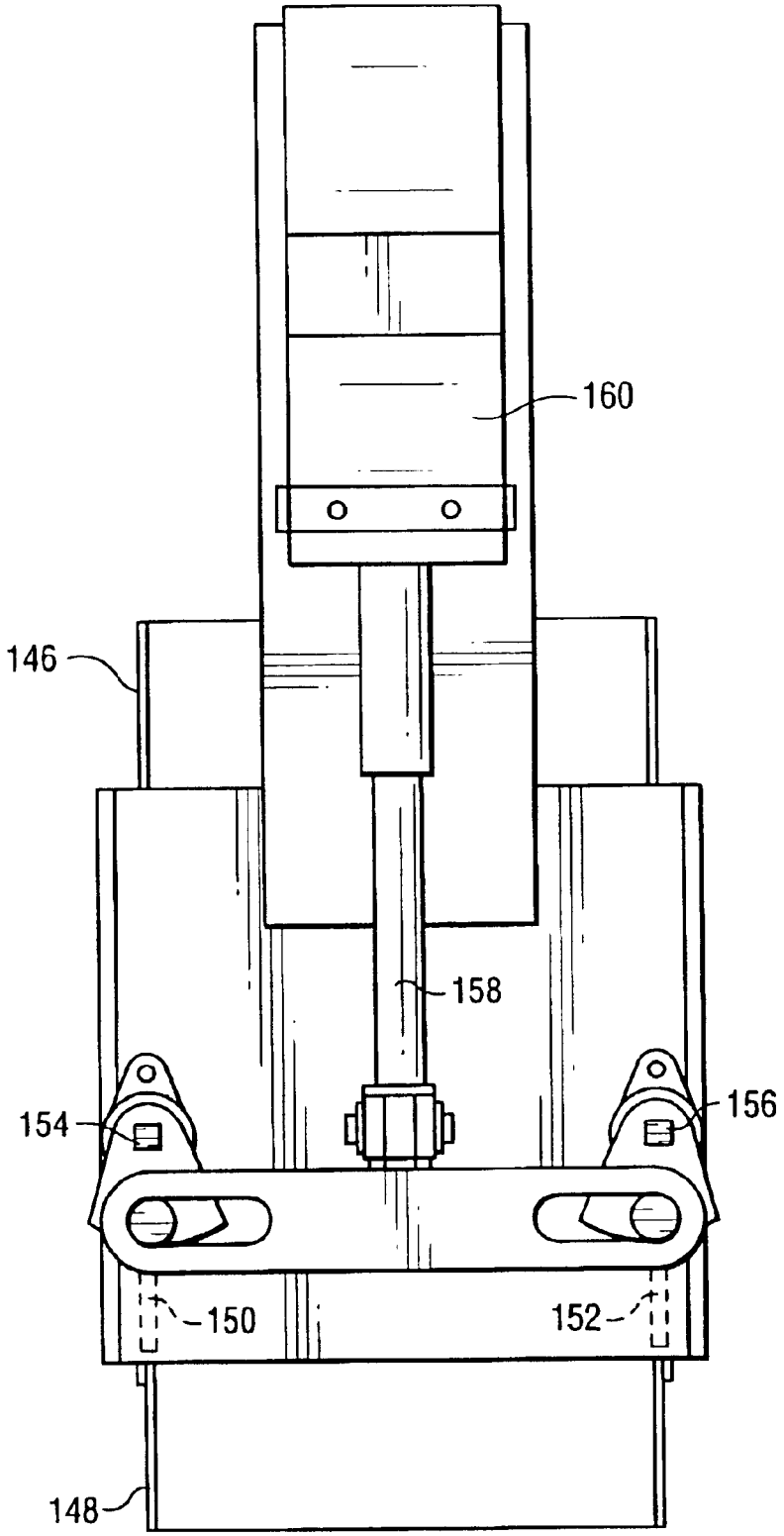
FIG. 13 is a side elevation of the coal damper shown in FIG. 12, with the orifice plates moved to a cleaning position.
Figure 17:
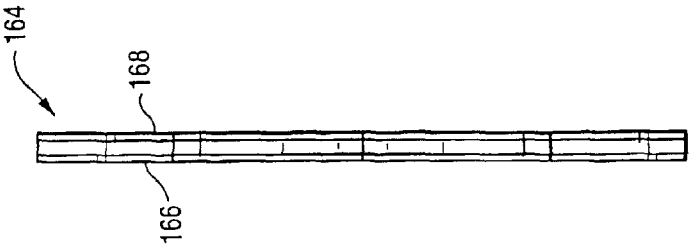
FIG. 17 is a side elevation of the orifice plate shown in FIG. 15, but with the pivot shaft removed.
Figure 15:
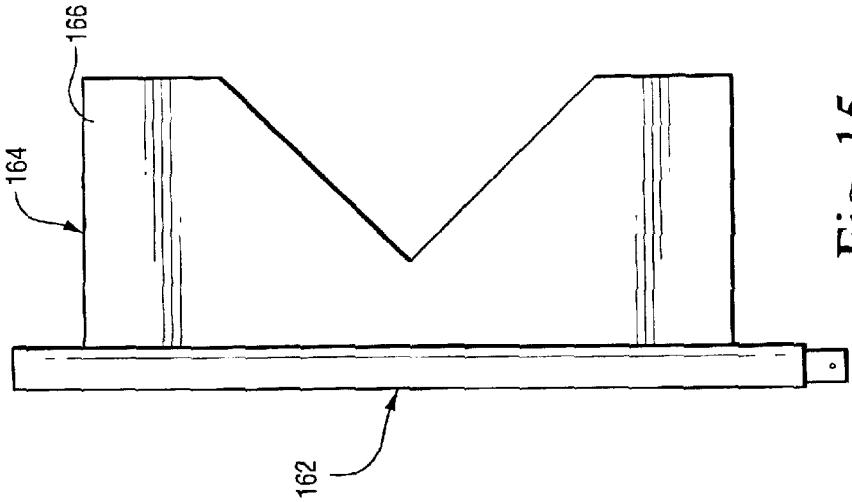
FIG. 15 is a plan view of a pivot shaft and orifice plate where the orifice plate is provided with tiled surfaces.
Figure 16:
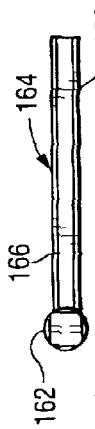
FIG. 16 is a front elevation of the orifice plate shown in FIG. 15.
Figure 14:
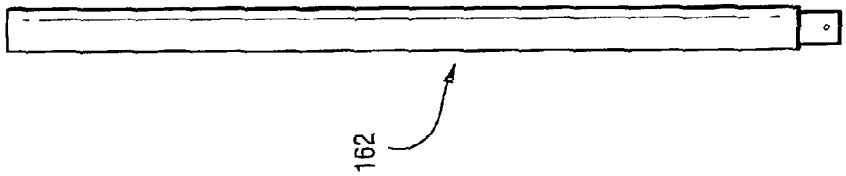
FIG. 14 is a plan view of a pivot shaft of the type used in FIGS. 1–13.

In an alternative arrangement illustrated in FIGS. 11–13, a damper 142 includes a damper body 144 and pipe sections 146, 148. In this embodiment, the damper body 144 is lengthened axially (relative to damper body 82) and the orifice plates 150, 152 (FIG. 13) are arranged so as to pivot about the horizontal centerline of the damper body, on shafts 154, 156. This arrangement provides the necessary space for allowing the orifice plates 150, 152 to be rotated, via shaft 158 and actuator 160, from a fully open position (as described in connection with the first embodiment and as shown in FIGS. 9 and 10) to a fully closed position, and then beyond to a self-cleaning position where the orifice plates have been rotated downwardly 180° (relative to the fully open position) to the position shown in FIG. 13. Thus, any coal or other debris that has settled on the orifice plates can be removed by gravity and/or flow pressure, simply by extending the rod 158 of the linear actuator to pivot the orifice plates downwardly as described above. The damper 142 is otherwise similar to the damper shown in FIGS. 2–10.

Referring now to FIGS. 14 through 17, the orifice plate pivot shafts (one shown at 162) may be sprayed with a ceramic coating and the orifice plates (one shown at 164) themselves may have a ceramic lip tile 166, 168 vacuum bonded to the upper and lower surfaces of the plates. The lip tile may be ⅛" thick on a 0.375" thick orifice plate, but these dimensions are exemplary only.

Figure 18:
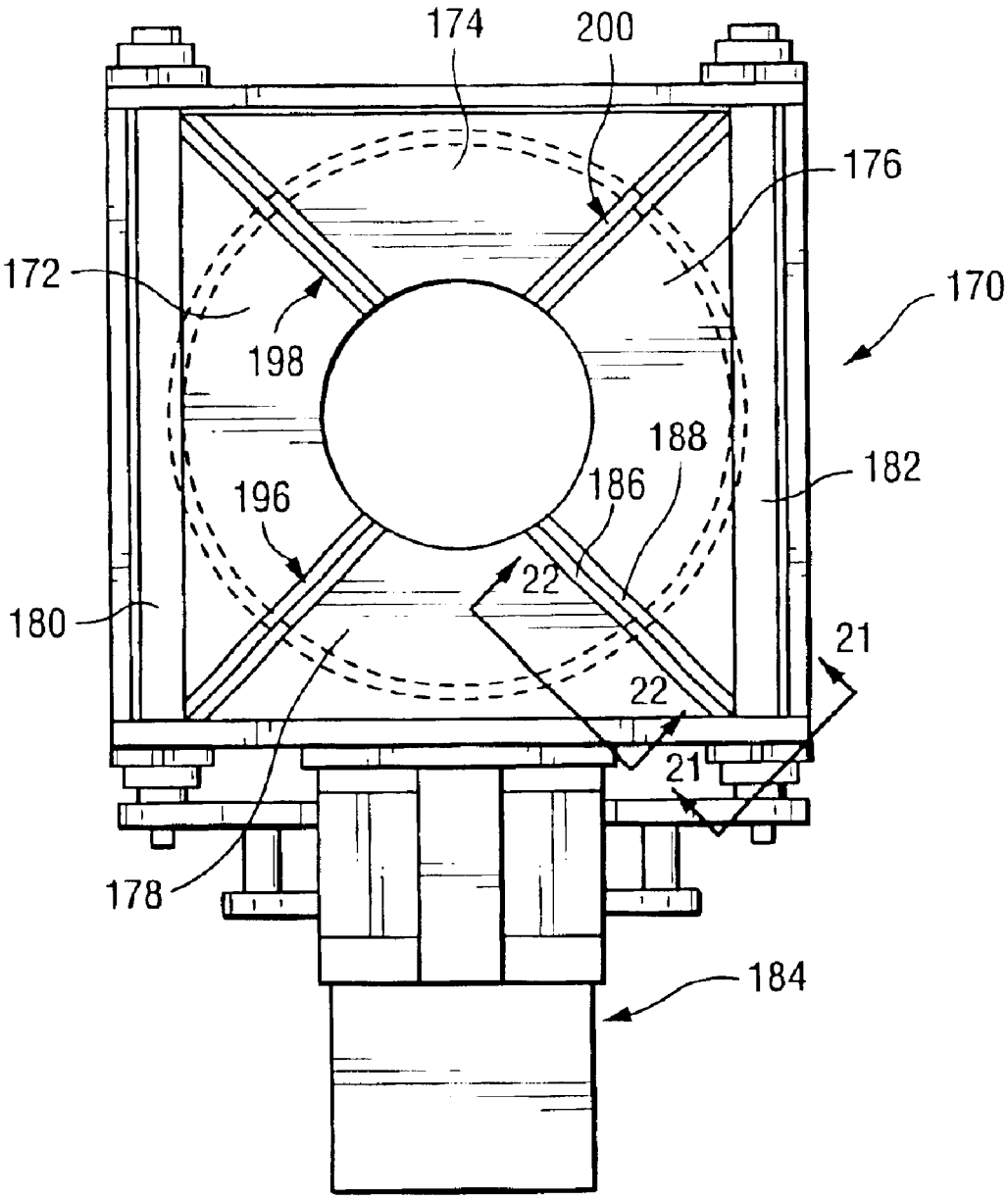
FIG. 18 is a plan view of an automatic coal damper in accordance with another exemplary embodiment of the invention, with the orifice plates shown in the fully closed position.
Figure 19:
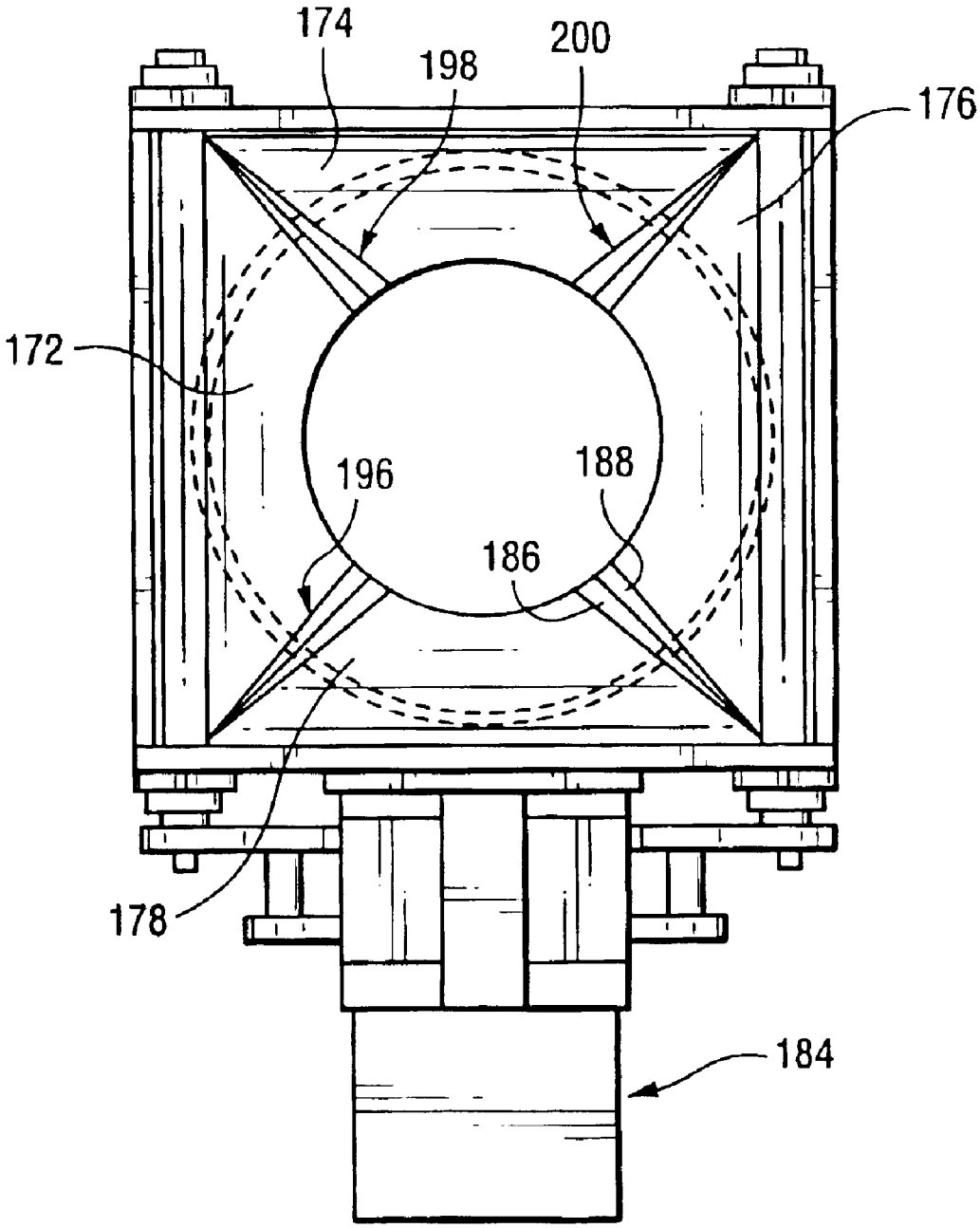
FIG. 19 is a plan view similar to FIG. 18, but with the orifice plates shown in a 45° open position.
Figure 20:
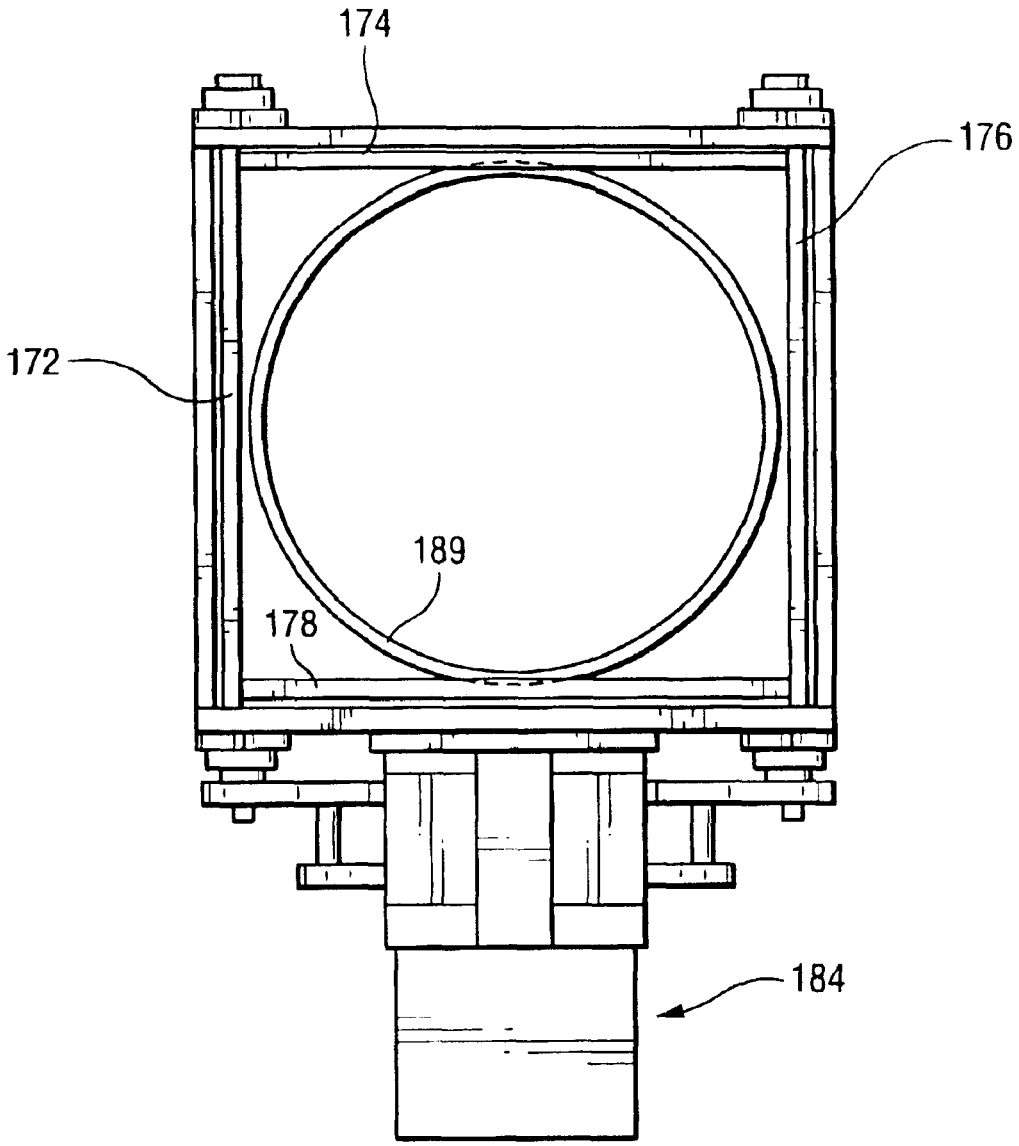
FIG. 20 is a plan view similar to FIGS. 18 and 19, but with the orifice plates shown in a fully open position.
Figure 22:
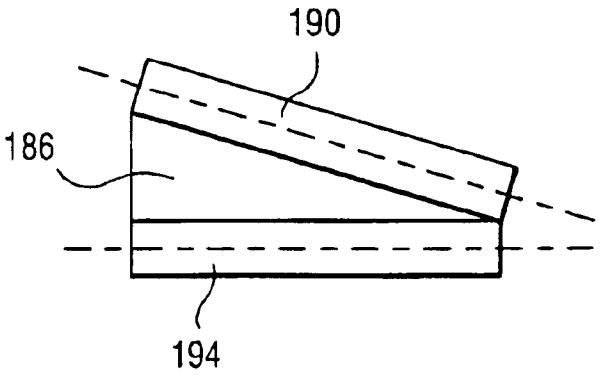
FIG. 22 is a section view in schematic form taken along the line 22—22 of FIG. 18.
Figure 21:
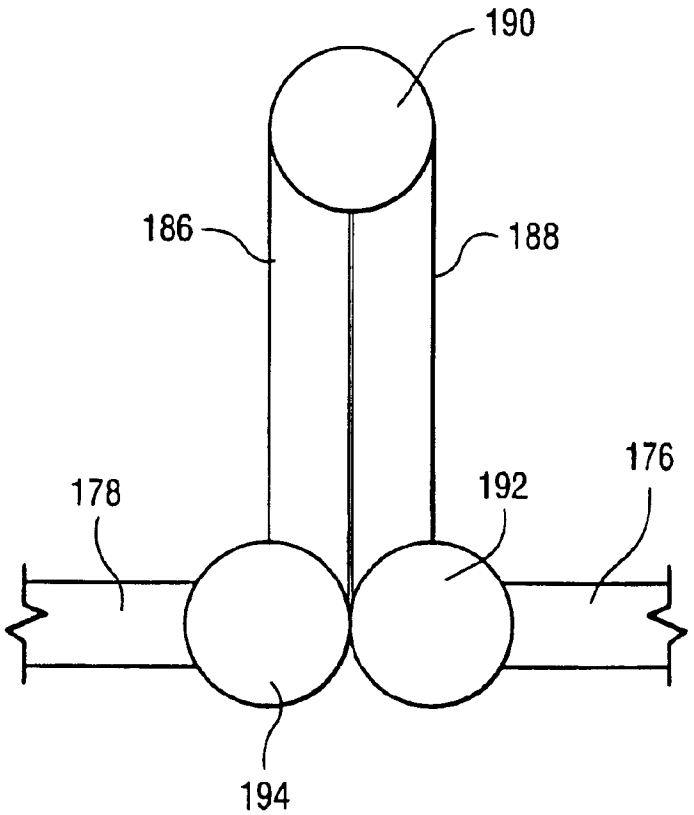
FIG. 21 is a section view in schematic form taken along the line 21—21 in FIG. 18.

Turning now to FIGS. 18 through 23, another embodiment of a damper is shown where the damper body 170 may include four orifice plates 172, 174, 176 and 178, two of which (172 and 176) are secured to respective pivot shafts 180, 182. The pivot shafts are, in turn, driven by the linear actuator 184 in the same manner as described above. The two remaining orifice plates 174, 178 are idler plates that are hingedly connected to opposite ends of the adjacent driven orifice plates 172, 176 by two connecting triangular shaped hinged plates at each of four locations. Since the hinge arrangement at each location is identical, only one need to be described. With reference specifically to FIGS. 18, 19, 21 and 22, the driven orifice plate 176 is connected to idler orifice plate 178 (in the lower right hand corner of FIGS. 18, 19) by hinge plates 186, 188. As best seen in FIGS. 21 and 22, the hinge plates 186, 188 are hinged to each other via hinge 190, to the driven orifice plate 176 via hinge 192, and to the idler orifice plate 178 via hinge 194. A similar hinged arrangement is provided at the remaining three hinged connection locations at 196, 198 and 200 (FIGS. 18 and 19).

At each of the four noted locations, the two triangular shaped hinge plates 186, 188 fold together in the fully closed orifice position (FIG. 19) and fold completely apart in the fully open orifice position such that flow through pipe section 189 is totally unobstructed (FIG. 21). FIG. 20 illustrates the orifice plates on a 45° open position.

The hinges 190, 192 and 194 are preferably ceramic sleeve hinges, allowing the idler plates to rotate freely about the hinge in the abrasive and hot environment typical of coal piping applications. The ceramic sleeve arrangement also prevents the coal from binding the rotation action of the pivot shafts 180, 182. It will be understood that the triangular shaped orifice plate size and orientation may be customized for the requirements of a particular boiler installation. The mechanical advantage of this arrangement is that the orifice remains symmetrically centered in the coal pipe. Otherwise, the actuation of the orifice plates via the linear actuator remains as described above.

FIGS. 23 through 26 illustrate a presently preferred damper 202 comprising a damper body 204 that is substantially cylindrical in shape, such that the cross-sectional shape of the flow path through the damper body is similar to the cross-sectional shapes of the pipe sections 206, 208 and attached system piping. The damper body 204 and pipe sections 206 and 208 may have substantially identical diameters and are joined at respective radial flange pairs 210, 212, respectively, by bolts 214 or other suitable fastening means.

Figure 23:
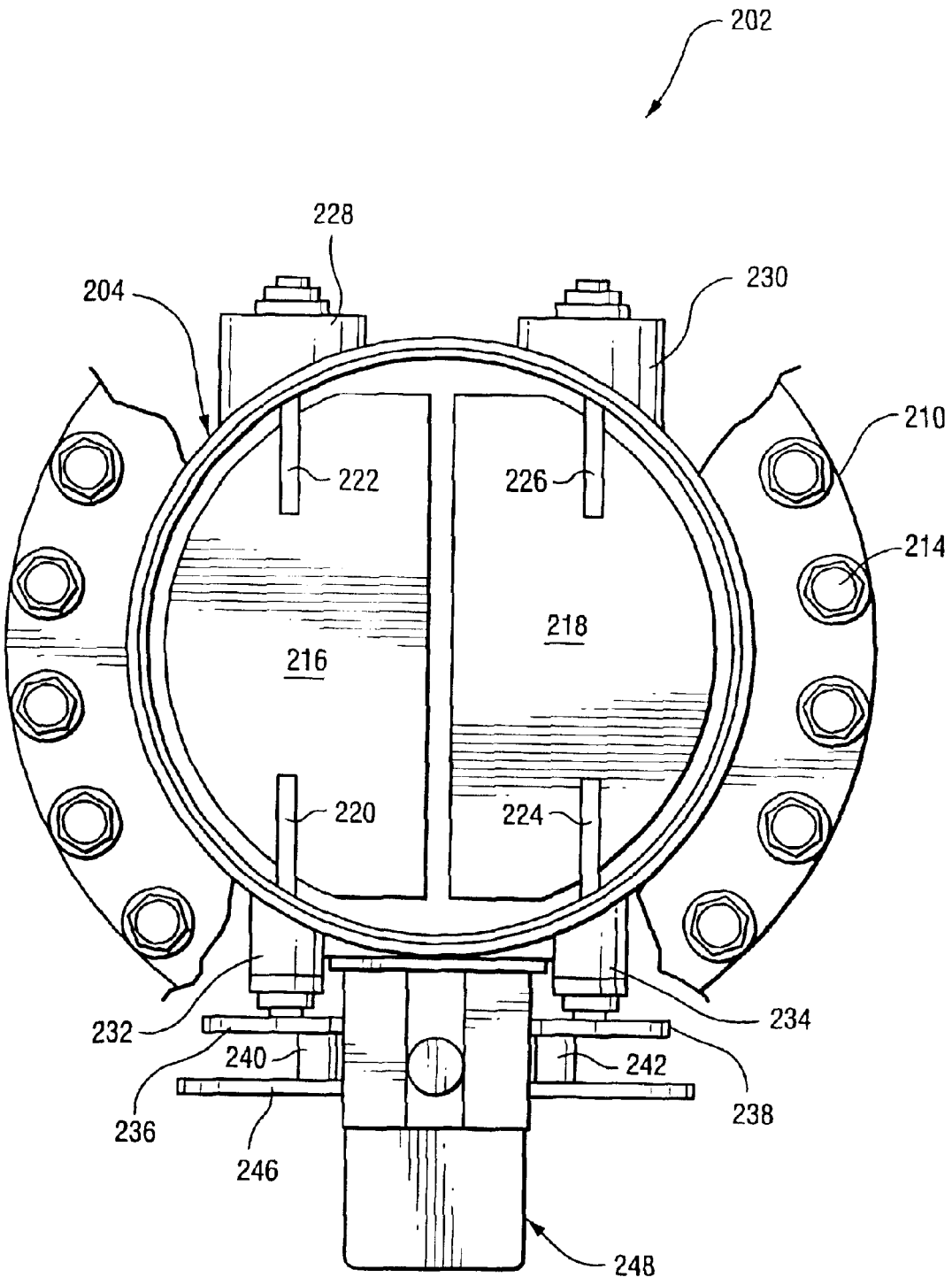
FIG. 23 is a plan view, partly broken away, illustrating an automatic coal damper in accordance with still another embodiment of the invention.
Figure 24:
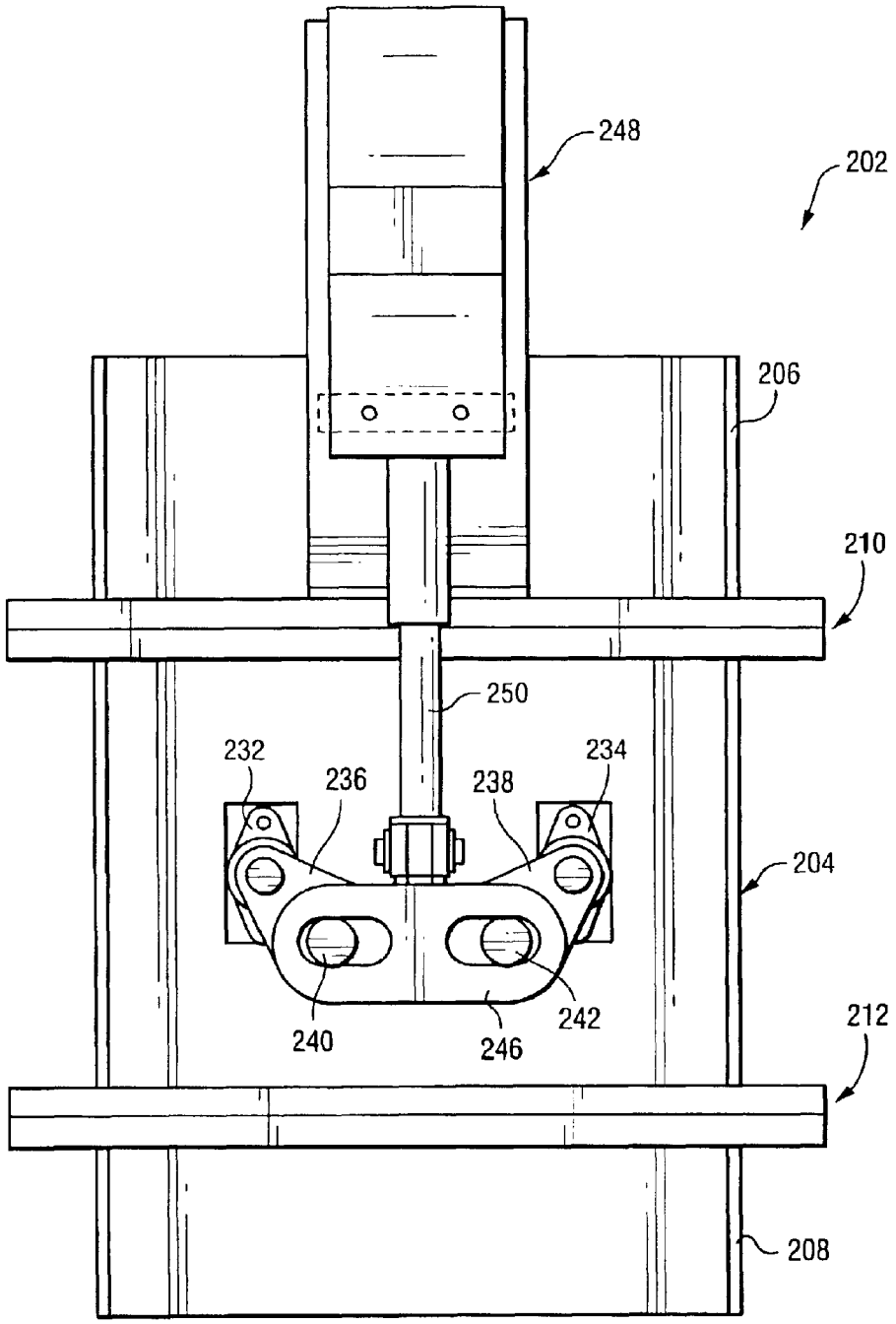
FIG. 24 is a front elevation of the coal damper of FIG. 23.
Figure 25:
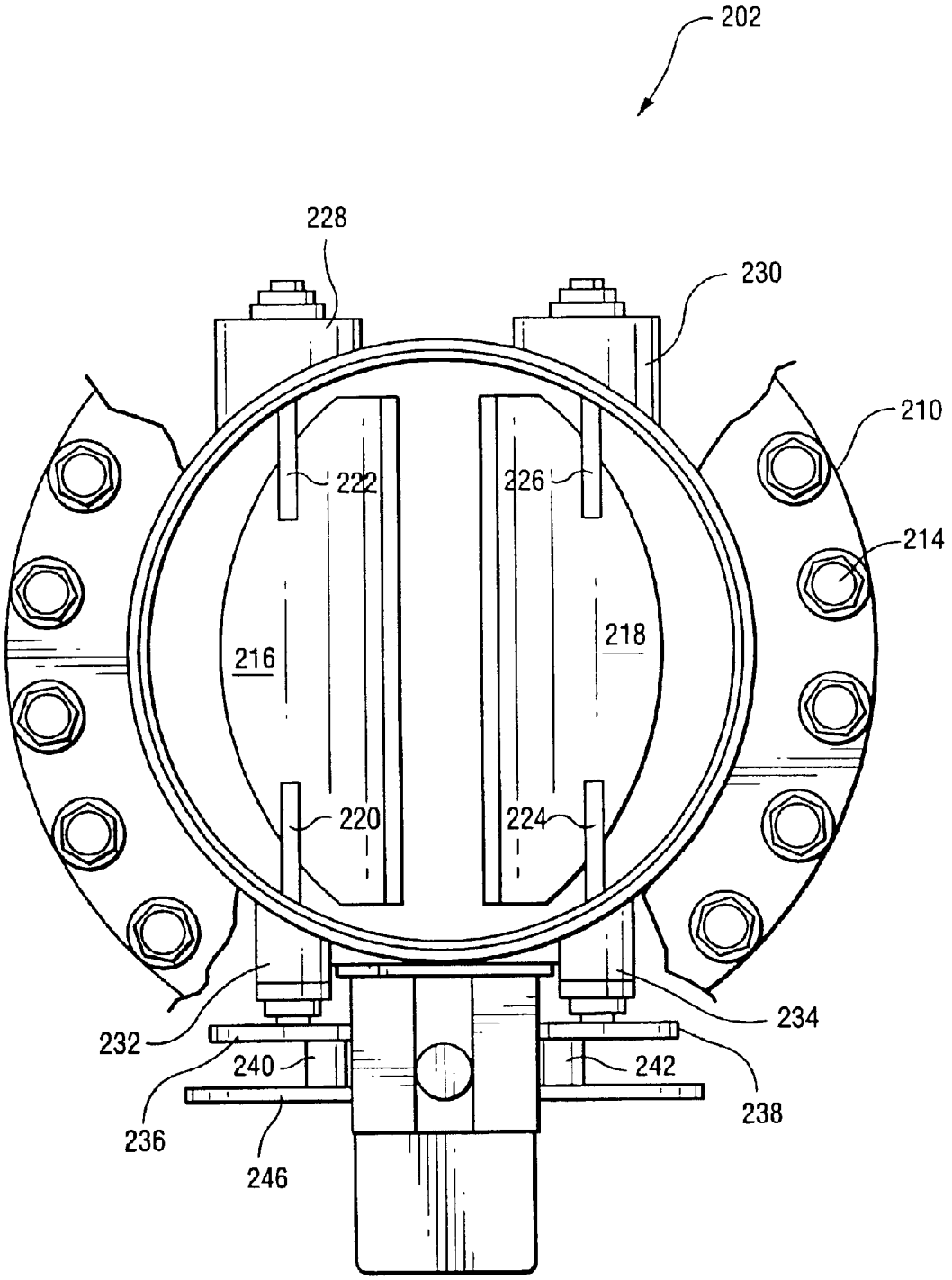
FIG. 25 is a plan view similar to FIG. 23 but with the orifice plates in 45° open position.
Figure 26:
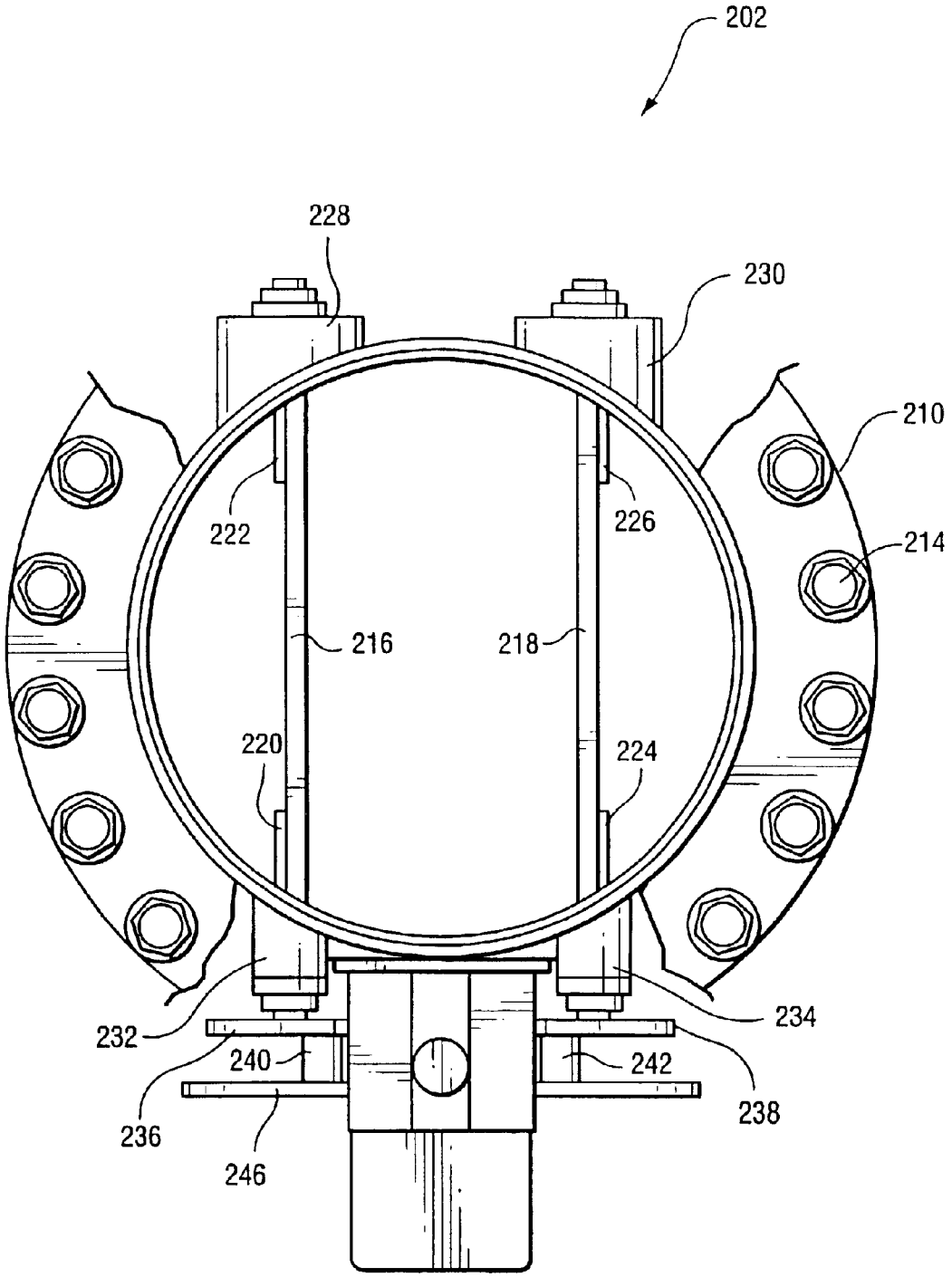
FIG. 26 is a plan view similar to FIG. 23 but with the orifice plates in a fully open position.

In this embodiment, the orifice plates 216, 218 have been redesigned to conform to the cylindrical damper body 204. Orifice plate 216 is secured to pivot pins or stubs 220, 222, while plate 218 is secured to pivot pins or stubs 224, 226. Pins 222, 226 are terminated in bearings 228, 230, respectively, while pins 220, 224 extend through respective bearings 232, 234 and terminate at respective cam rotors 236, 238. The cam rotors have respective rollers 240, 242 that are captured in the slotted cam 246, and linear actuator 248 moves the slotted cam 246 via rod or shaft 250 in the same manner as described hereinabove to adjust the orifice plates 216, 218 as desired. Note that in this embodiment, the "orifice" when the plates 216, 218 are closed as shown in FIG. 23, comprises the space around and between the plates. FIG. 25 illustrates the orifice plates 216, 218 at a 45° angle position and FIG. 26 illustrates the orifice plates 216, 218 in the fully open position.

The movement of the linear actuator rod 108 is controlled by the programmable logic controller system 72 utilizing real time primary air flow and pulverized coal flow signals. These signals are generated by monitors 46, 48 and 50, preferably using the real time flow measurement technique described in U.S. Pat. No. 6,109,097 and available from Air Monitor Corporation (known as Air Monitor Pf-FLO coal flow monitoring devices). The real time coal flow measurement monitors are combined with the primary control system 72, which may be a GE Fanuc 90/30 PLC or other suitable controller, integrated with, for example, GE Cimplicity graphics for the operator interface and GE VersaPro Software for the ladder logic to implement the control logic. The software is programmed with an algorithm for balanced damper positions at various coal flow and boiler loads. The damper position algorithm will respond to a proportional plus integral feedback function, including a database of known operating points as derived from baseline test data. The operator PC 74 will be programmed to interface and implement the control logic.

Primary fan air flow exiting the coal pulverizer requires a velocity in the range of 3,600 to 5,400 feet per minute in order to maintain entrainment of the coal. An acceptable weight ratio of air flow divided by coal flow (in terms of KLB/HR) is in the range of 1.8 to 2.5, depending upon pulverizer grinding conditions. If the system detects a low velocity in any pipe, balancing will be sacrificed and that particular pipe's coal damper will be opened while the other pipes' coal dampers will be closed. This should prevent coal flow interruptions in the pipe.

The Automatic Coal Damper electric motor actuator changes the mechanical orifice size and thus the hydraulic pressure loss coefficient ("K" value) in accordance with the following formula:

$$P=K*V^2$$

Where:

P=Pressure Loss

K=Hydraulic Loss Coefficient

V=Velocity of Coal or Primary Air

There are two contemplated operating modes: balance mode and manual mode. When in manual mode, the operator selects the percentage of coal damper orifice opening for each electric motor actuator. The system does not make outputs in response to coal imbalance or low velocity alarm conditions. The automatic coal dampers are to be initially operated based upon coal flow performance test results.

When in the balance mode, the system 72 will operate to balance the coal flow of the respective coal pipes. The balancing algorithm will cycle and idle at a predetermined rate. At the beginning of a cycle, the algorithm will add up all of the flows in the various parallel piping paths. Any pipe with a flow that is higher than the chosen tolerance above the average, will have a predetermined amount, e.g., 2%, subtracted from the output to its individual damper. Any pipe with a flow that is lower than the chosen tolerance above the average damper position will have a predetermined amount, e.g., 2%, added to the output to its individual damper. After a predetermined cycle time (a 3 to 10 minutes cycle time range is selectable by the operator) of, e.g., 100 seconds, the algorithm will repeat. The control adjustments are made with the secondary purpose of keeping the farthest open damper at 90–105% open. If the farthest open damper is above or below this range, 0.5%, for example, will be added or subtracted to each damper output.

In the balance mode, coal balancing will be over ridden if one or more of the pipe velocities falls below an alarm set point (3000 ft/sec, for example). If this happens, 2% (or other predetermined amount) will be added to the valve output to the low velocity pipe(s) and 2% (or other predetermined amount) will be subtracted from the valve outputs with velocities above 3000 ft/sec. In manual mode, the damper outputs will not be adjusted unless selected and entered by the operator.

EXAMPLE

For a one mill, three parallel piping path arrangement, the control system will determine which flow path 34, 36 or 38 has the least amount of coal flow. This path 34, 36 or 38 will then be set by the system to the full-open orifice damper position. The remaining damper position set points (two of the set 34, 36, 38) will be determined to maintain the coal flow at an equal or selectable value for each of the three paths 34, 36 or 38. The same algorithm would also applies for 4 or more parallel paths of coal pipes from a pulverizer to multiple burners.

The individual coal flows are simulated by first adding the 3 feedback readings to the automatic coal damper outputs. The pipe feed signal is obtained by multiplying the coal feeder RPM by the calculated ratio of the given pipe's automatic coal damper position command to the sum of all damper position indications. The coal flow reading is in KLB/HR for each coal pipe. For example, if the pulverizer mill KLB/HR reading was 600 and each valve was open at least 95%, the LKB/HR reading would be 200 KLB/HR for a "balanced" condition at each pipe.

The velocities for each pipe can be changed by selection at their respective numerical values. The mill coal feeder RPM speed can be changed by selection at the screen numerical value. This functionality allows the operator to change the total amount of coal entering the mill (system total for pipes 34, 36 and 38). The individual pipe position readings are hard-wired from the controller analog outputs to the damper actuators. For example, if the output to the damper actuator is 30%, the instantaneous analog input signal from the damper actuator position is 30%. The primary air flow rate (KLB/HR) speed can be changed by selection of the screen numerical value.

It will be appreciated that the system as described will provide operational cost reduction for the coal-fired boiler utility customers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An automatic coal damper for use in controlling flow of primary air and pulverized coal to a burner of a coal-fired boiler comprising a damper body having pipe sections on either end thereof, said damper body and said pipe sections defining a flow path for the primary air and pulverized coal; said damper body having at least two adjustable orifice plates secured to respective pivot shafts mounted in said damper body, and a linear motor actuator including a reciprocable output shaft mounted on said damper body and operatively connected to said pivot shafts for moving said orifice plates away from each other or toward each other between respective open and closed positions.

2. The automatic coal damper of claim 1 wherein each damper includes a damper body and four adjustable orifice plates.

3. An automatic coal damper for use in controlling flow of primary air and pulverized coal to a burner of a coal-fired boiler comprising a damper body having pipe sections on either end thereof, said damper body having at least two adjustable orifice plates secured to respective pivot shafts mounted in said damper body, and a linear actuator mounted on said damper body and operatively connected to said pivot shafts for moving said orifice plates between open and closed positions; wherein said orifice plates are shaped to provide an orifice opening when the orifice plates are in the closed position that is about 25% of the orifice opening when the orifice plates are in the open position.

4. An automatic coal damper for use in controlling flow of primary air and pulverized coal to a burner of a coal-fired boiler comprising a damper body having pipe sections on either end thereof, said damper body having four adjustable orifice plates secured to respective pivot shafts mounted in said damper body, and a linear actuator mounted on said damper body and operatively connected to said pivot shafts for moving said orifice plates between open and closed positions; wherein two driven plates of said four adjustable orifice plates are connected to said linear actuator, and wherein each of two remaining idler plates of said four adjustable orifice plates are hinged to adjacent ones of said two driven plates.

5. The automatic coal damper of claim 4 wherein said driven plates and idler plates are connected by ceramic sleeve hinges.

6. A coal-fired boiler plant comprising plural parallel piping paths from at least one pulverizer mill that supply air and pulverized coal to a corresponding plurality of burners of a coal-fired boiler; a plurality of mechanical dampers located, respectively, in said plural parallel piping paths, each damper having at least a pair of pivotally adjustable and cooperable orifice plates for adjusting flow of air and pulverized coal in a respective one of said piping paths; and including an electric motor linear actuator having a reciprocable output shaft operatively connected to said orifice plates for adjusting said orifice plates in real time to balance the flow of air and pulverized coal for each of said plural parallel piping paths.

7. An automatic coal damper for use in controlling flow of primary air and pulverized coal to a burner of a coal-fired boiler comprising a damper body having pipe sections on either end thereof, said damper body having at least two adjustable orifice plates secured to respective pivot shafts mounted in said damper body, and a linear actuator mounted on said damper body and operatively connected to said pivot shafts for moving said orifice plates between open and closed positions; wherein said orifice plates are fixedly secured to respective pivot shafts that are mounted in said damper body for rotation about parallel axes, each pivot shaft keyed to one end of a rotatable cam rotor, an opposite end of the cam rotor mounting a roller captured in a slot in a cam plate; said linear motor actuator provided with an actuator rod movable in either of two opposite directions, and connected to said cam plate, wherein movement of actuator rod and said cam plate causes said orifice plates to pivot simultaneously toward said open or closed position depending on the direction of movement of said actuator rod.

8. The automatic coal damper of claim 7 wherein said actuator rod is oriented parallel to a direction of flow through said damper body and wherein said pivot shafts are oriented perpendicular to said direction of flow.

9. The automatic coal damper of claim 7 wherein said damper body is substantially cylindrical in shape, with substantial cylindrical pipe sections extending in either side thereof.

10. The automatic coal damper of claim 9 wherein said orifice plates are movable between a fully open position where the plates are substantially parallel to a direction of flow through the damper; a closed position where the orifice plates are substantially perpendicular to the direction of flow; and a cleaning position where the orifice plates are substantially parallel to the direction of flow, 180° from the fully open position.

11. The automatic coal damper of claim 9 wherein said damper body and said pipe sections have substantially identical diameters.

12. Apparatus for controlling primary air flow and pulverized coal flow to a plurality of burners in a coal-fired boiler comprising:

a plurality of coal dampers arranged to supply a mixture of air and pulverized coal to respective burners in the coal-fired boiler, each damper having a damper body and at least two orifice plates pivotally secured therein, said orifice plates movable between open and closed positions;

a real time coal flow monitoring device operatively associated with each damper that is adapted to generate analog signals representing real time coal flow through its respective damper; and a programmable logic controller adapted to receive said analog signals and to adjust said orifice plates to balance the flow of air and pulverized coal to each of the plurality of burners; wherein said orifice plates are shaped to provide an orifice opening when said orifice plates are in the closed position that is about 25% of the orifice opening when said orifice plates are in the open position.

13. Apparatus for controlling primary air flow and pulverized coal flow to a plurality of burners in a coal-fired boiler comprising:

a plurality of coal dampers arranged to supply a mixture of air and pulverized coal through a corresponding plurality of pipes to respective burners in the coal-fired boiler, each damper having a damper body and at least two orifice plates pivotally secured therein, said orifice plates driven by an electric motor linear actuator including a reciprocable output shaft, and cooperably movable away from and toward each other between respective open and closed positions to control flow of said mixture through said damper;

a real time coal flow monitoring device operatively associated with each damper that is adapted to generate analog signals representing real time coal flow through its respective damper; and a programmable logic controller adapted to receive said analog signals and to adjust said orifice plates to balance the flow of air and pulverized coal to each of the plurality of burners.

14. The apparatus of claim 1 wherein said orifice plates are fixedly secured to respective pivot shafts that are mounted in said damper body for rotation about parallel axes, each pivot shaft keyed to one end of a rotatable cam rotor, an opposite end of the cam rotor mounting a roller captured in a slot in a cam plate; said reciprocable output shaft connected to said cam plate, wherein movement of said reciprocable output shaft and said cam plate causes said orifice plates to pivot simultaneously toward said open or closed position depending on the direction of movement of said reciprocable output shaft.

15. The apparatus of claim 14 wherein said reciprocable output shaft is oriented parallel to a direction of flow through said damper body and wherein said pivot shafts are oriented perpendicular to said direction of flow.

16. The apparatus of claim 1 wherein said damper body is substantially cylindrical in shape, with substantial cylindrical pipe sections extending in either side thereof.

17. The apparatus of claim 16 wherein said damper body and said pipe sections have substantially identical diameters.

18. The apparatus of claim 1 wherein each damper includes a damper body and four adjustable orifice plates, said orifice plates movable between open and closed positions.

19. The apparatus of claim 18 wherein said orifice plates are shaped to provide an orifice opening when the orifice plates are in the closed position that is about 25% of the orifice opening when the orifice plates are in the open position.

20. The apparatus of claim 18 wherein two driven plates of said four orifice plates are connected to said electric motor linear actuator, and wherein each of two remaining idler plates of said four orifice plates are connected to adjacent ones of said two driven plates.

21. The apparatus of claim 20 wherein said driven orifice plates are fixedly secured to respective pivot shafts that are mounted in said damper body for rotation about parallel axes, each pivot shaft keyed to one end of a rotatable cam rotor, an opposite end of the cam rotor mounting a roller captured in a slot in a cam plate; said reciprocable output shaft connected to said cam plate, wherein movement of reciprocable output shaft and said cam plate causes said driven orifice plates and said idler orifice plates to move simultaneously toward said open or closed position depending on the direction of movement of said reciprocable output shaft.

22. The apparatus of claim 20 wherein said driven plates and idler plates are connected by ceramic sleeve hinges.

23. Apparatus for controlling primary air flow and pulverized coal flow to a plurality of burners in a coal-fired boiler comprising:

a plurality of coal dampers arranged to supply a mixture of air and pulverized coal to respective burners in the coal-fired boiler, each damper having a damper body and at least two orifice plates pivotally secured therein, said orifice plates movable between open and closed positions;

a real time coal flow monitoring device operatively associated with each damper that is adapted to generate analog signals representing real time coal flow through its respective damper; and a programmable logic controller adapted to receive said analog signals and to adjust said orifice plates to balance the flow of air and pulverized coal to each of the plurality of burners; wherein said orifice plates are movable between a fully open position where the plates are substantially parallel to a direction of flow through the damper; a closed position where the orifice plates are substantially perpendicular to the direction of flow; and a cleaning position where the orifice plates are substantially parallel to the direction of flow, 180° from the fully open position.

* * * * *